US008153210B2

(12) United States Patent
Kawakami et al.

(10) Patent No.: US 8,153,210 B2
(45) Date of Patent: Apr. 10, 2012

(54) RECORDING MEDIUM, METHOD FOR MANUFACTURING SAME, AND INKJET RECORDING METHOD

(75) Inventors: Hiroshi Kawakami, Fujinomiya (JP); Ryoichi Nakano, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 757 days.

(21) Appl. No.: 12/272,506

(22) Filed: Nov. 17, 2008

(65) Prior Publication Data

US 2009/0130309 A1 May 21, 2009

(30) Foreign Application Priority Data

Nov. 19, 2007 (JP) ..... 2007-299927

(51) Int. Cl.
*B41M 5/40* (2006.01)

(52) U.S. Cl. ..... 428/32.21; 428/32.24; 428/32.25; 428/32.34; 427/243; 347/105

(58) Field of Classification Search ..... 428/32.21, 428/32.24, 32.25, 32.34; 427/243; 347/105
See application file for complete search history.

(56) References Cited

U.S. PATENT DOCUMENTS 8,007,879 B2 * 8/2011 Nakano ..... 428/32.21
8,034,423 B2 * 10/2011 Kawakami et al. ..... 428/32.21
2004/0090513 A1 * 5/2004 Ohya et al. ..... 347/105
2005/0069655 A1 * 3/2005 Yamamoto et al. ..... 428/32.18
2009/0130309 A1 * 5/2009 Kawakami et al. ..... 427/261

FOREIGN PATENT DOCUMENTS

| | | | |
|---|---|---|---|
| EP | 0 695 789 | A1 | 2/1996 |
| JP | 9-109339 | | 4/1997 |
| JP | 2003-278096 | | 10/2003 |
| JP | 2005-96285 | | 4/2005 |
| JP | 2005-238829 | | 9/2005 |
| JP | 2006-169685 | A | 6/2006 |
| JP | 2007-237524 | A | 9/2007 |

OTHER PUBLICATIONS

EP Communication, dated Feb. 5, 2009, issued in corresponding EP Application No. 08020087.6, 5 pages.

* cited by examiner

*Primary Examiner* — Betelhem Shewareged
(74) *Attorney, Agent, or Firm* — Sughrue Mion, PLLC

(57) ABSTRACT

A recording medium in which a base paper, a first layer including a binder and an antistatic agent, and a second layer including a white pigment are formed in this order; the content of the antistatic agent is from 0.2% by mass to 10% by mass based on an amount obtained by removing the antistatic agent from all solids in the first layer; the Cobb water absorption degree within a contact time of 120 sec at a surface of the first layer of the base paper provided with the first layer is 2.0 g/m$^2$ or less, and the surface resistivity at 50% RH and 23° C. on the surface is $1\times10^{12}\Omega$ or less; and the water absorption amount within a contact time of 0.5 sec determined by a Bristow test at a surface of the second layer is from 2 mL/m$^2$ to 8 mL/m$^2$.

15 Claims, 3 Drawing Sheets

RECORDING MEDIUM, METHOD FOR MANUFACTURING SAME, AND INKJET RECORDING METHOD

CROSS-REFERENCE TO RELATED APPLICATION

This application claims priority under 35 USC 119 from Japanese Patent Application No. 2007-299927, the disclosure of which is incorporated by reference herein.

BACKGROUND OF THE INVENTION

1. Field of the Invention

The present invention relates to a recording medium, a method for manufacturing same, and an inkjet recording method using same.

2. Description of the Related Art

An inkjet apparatus has a simple structure, and high-quality image recording can be conducted by inkjet recording performed using the inkjet apparatus. The viscosity of the ink used for inkjet recording is adjusted to a range from about several mpa·s to about 30 mPa·s and the ink is designed to have a surface tension of about 20 mN to about 40 mN/m, so that the ink can be ejected from an inkjet head.

The ink usually includes 50% to 90% by mass ink solvent so as to obtain the ink viscosity within the aforementioned range. Examples of suitable ink solvents include water, organic solvents, oils, and photopolymerizable monomers. From the standpoint of environmental compatibility, water is most often used. Further, a high-boiling solvent such as glycerin is generally used as an ink solvent in order to prevent an ejection nozzle of the inkjet head from being clogged due to drying of the ink solvent.

On the other hand, where a large amount of ink solvent is present on a recording medium where an ink image has been formed, image bleeding and mixing of colors caused by the large amount of ink solvent can easily occur. For this reason an inkjet special paper 200 (see FIG. 5) having on the surface thereof a solvent absorbing layer (ink accommodating layer) that has a thickness of about 20 μm to 30 μm and is capable of absorbing an ink solvent is used as a recording medium, thereby preventing the occurrence of image bleeding and color mixing.

In the case of an aqueous ink using water and the ink solvent, the water penetrates into the base paper during recording, thereby causing paper deformation such as curling. However, where a solvent-absorbing layer 22 is present on a base paper 21, as shown in FIG. 5, water is prevented from penetrating into the base paper and paper deformation can be inhibited.

In particular, when graphical images with a high image density and a high image surface area ratio are to be formed, the amount of ink per unit surface area on the recording medium increases, and the solvent absorbing layer can hardly prevent the ink solvent from penetrating into the base paper. For this reason, water-resistance paper (for example, laminate paper) that is covered with a resin layer using a polyolefin or the like is typically used (for example, see JP-A Nos. 2005-238829 and 2005-96285).

However, inkjet technology is not only used in connection with office printers and home printers. In recent years, it has been applied to the field of commercial printing. In commercial printing, printed sheets are required to have an appearance similar to that of general printing paper, rather than a surface, such as that of a photograph, that completely blocks penetration of ink solvent into base paper. However, the range of properties such as surface gloss, texture and stiffness is limited when a recording medium has a solvent absorption layer with a thickness as large as from 20 μm to 30 μm. Therefore, application of inkjet techniques in commercial printing has been limited, for example, to posters and vouchers, with respect to which the restrictions on surface gloss, texture, stiffness and the like are tolerable.

Further, the presence of a solvent absorbing layer and a water-resistant layer increases the cost of recording medium, thereby placing additional limitations on the application thereof.

Resin-coated paper for recording that is coated with a polyolefin resin including an antistatic agent is known as a recording paper with good pick strength during recording and good conveying ability during printing (for example, see JP-A No.9-109339). Further, lightweight printing paper having a coating layer including an antistatic agent and having a surface resistivity is known as recording paper that bears no electric charges in the printing and drying process, despite a small metric weight thereof, and does not require humidification as an antistatic measure (for example, see JP-A No. 2003-278096).

SUMMARY OF THE INVENTION

The present invention has been made in view of the above circumstances and provides a first aspect of the invention provides a recording medium in which a base paper, a first layer including a binder and an antistatic agent, and a second layer including a white pigment are formed in this order, a content of the antistatic agent is from 0.2.% by mass to 10.0% by mass based on an amount obtained by removing the antistatic agent from all solids in the first layer, a Cobb water absorption degree within a contact time of 120 sec at a surface of the first layer of the base paper provided with the first layer is equal to or less than 2.0 g/m$^2$, a surface resistivity at 50% RH and 23° C. on the surface is $1\times10^{12}\Omega$ or less, and a water absorption amount within a contact time of 0.5 sec determined by a Bristow test at a surface of the second layer is from 2 mL/m$^2$ to 8 mL/m$^2$ or less.

A second aspect of the invention provides a method for manufacturing a recording medium, including applying a film forming liquid including thermoplastic resin particles and an antistatic agent to a base paper and heat treating within a temperature range equal to and higher than the lowest film forming temperature of the thermoplastic resin particles, thereby forming a first layer in which a content of the antistatic agent is from 0.2% by mass to 10.0% by mass based on an amount obtained by removing the antistatic agent from all solids in the first layer, and forming a second layer by applying a film forming liquid including a white pigment to the first layer, this method manufacturing the recording medium according to the first aspect of the invention.

A third aspect of the invention provides an inkjet recording method including applying an ink to the recording medium according to the first aspect of the invention and forming an ink image corresponding to the predetermined image data, and drying and removing an ink solvent in the recording medium on which the ink image has been formed.

DETAILED DESCRIPTION OF THE INVENTION

The recording medium, method for manufacturing same, and inkjet recording method using the recording medium in accordance with the invention will be described below in detail.

<Recording Medium>

Figure 1:
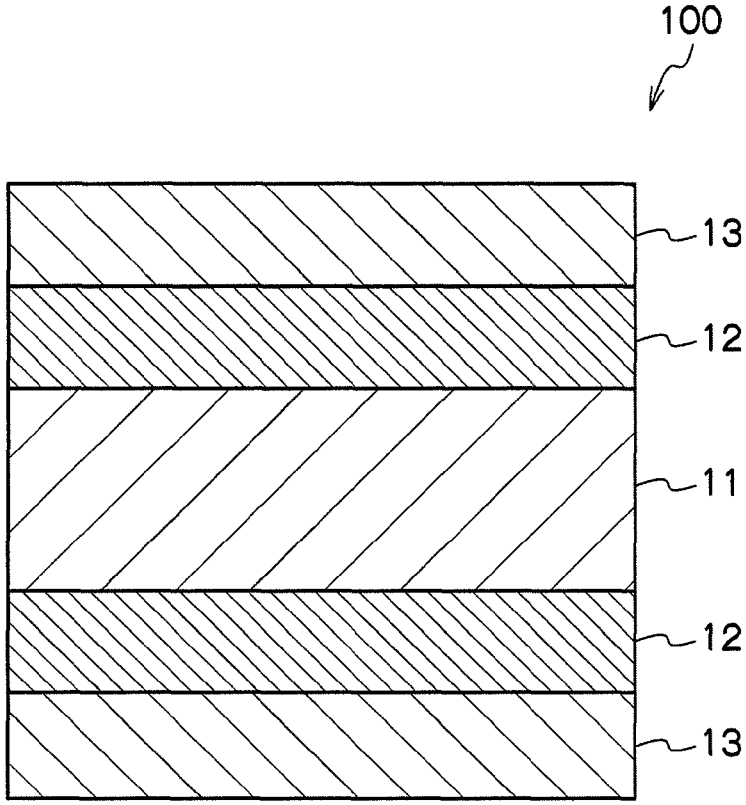
FIG. 1 is a schematic structural diagram illustrating a configuration example of the recording medium in accordance with the invention.

The recording medium in accordance with the invention includes a base paper and also a first layer and a second layer provided in this order from the base paper side. If necessary, the recording medium can include other appropriately selected layers. The recording medium in accordance with the invention, for example, as a recording medium 100 shown in FIG. 1, is composed of a high-grade paper 11 serving as a base paper, a solvent blocking layer 12 serving as a first layer and formed on the high-grade paper 11, and a coat layer 13 serving as a second layer formed on the solvent blocking layer 12. The recording medium may be a sheet paper or a roll paper.

(Base Paper)

The base paper is not particularly limited and can be appropriately selected from well-known types of paper according to the object.

From the standpoint of ensuring good balance of surface smoothness, rigidity, and dimensional stability (curling ability) of the base paper and also improving these properties to a high level, it is preferred that hardwood bleached Kraft pulp (LBKP) be used as a pulp serving as a starting material for the base paper. Softwood bleached Kraft pulp (NBKP) and leaf bleached sulfide pulp (LBSP) also can be used.

A beater or a refiner can be used for beating the pulp. If necessary, a variety of additives, for example, a filler, an agent enhancing a dry paper strength, a sizing agent, an agent enhancing a wet paper strength, a fixing agent, a pH adjuster, and other agents can be added to a pulp slurry (can be also referred to hereinbelow as "pulp paper material") obtained after beating the pulp.

Examples of the filler include calcium carbonate, clay, kaolin, white earth, talc, titanium oxide, diatomaceous earth, barium sulfate, aluminum hydroxide, and magnesium hydroxide.

Examples of the agent enhancing dry paper strength include cationic starch, cationic polyacrylamide, anionic polyacrylamide, amphoteric polyacrylamide, and carboxy-modified polyvinyl alcohol. Examples of the sizing agent include fatty acid salts, rosin, rosin derivatives such as maleated rosin, paraffin wax, alkylketene dimers, alkenyl succinic anhydride (ASA), and epoxidized fatty acid amides. Examples of the agent enhancing wet paper strength include polyamine polyamidoepichlorohydrin, melamine resins, urea resins, and epoxidized polyamide resins.

Examples of the fixing agent include polyvalent metal salts such as aluminum sulfate and aluminum chloride, and cationic polymers such as cationic starch.

Examples of the pH adjuster include caustic soda and sodium carbonate.

Examples of other agents include an antifoaming agent, a dye, a slime control agent, and a fluorescent whitening agent.

If necessary, a softening agent can be added to the pulp paper material. Examples of the softening agent are described in New Manual on Paper Processing (published by Kamiyaku Taimu KK), p. 554-555 (1980).

A treatment liquid used for surface sizing treatment may include a water-soluble polymer, a sizing agent, a water-resistance substance, a pigment, a pH adjuster, a dye, and a fluorescent whitening agent.

Examples of the water-soluble polymer include cationic starch, polyvinyl alcohol, carboxy-modified polyvinyl alcohol, carboxymethyl cellulose, hydroxyethyl cellulose, cellulose sulfate, gelatin, casein, sodium polyacrylate, styrene-maleic anhydride copolymer sodium salt, and sodium polystyrenesulfonate.

Examples of the sizing agent include a petroleum resin emulsion, a styrene-maleic anhydride copolymer alkyl ester ammonium salts, rosin, higher fatty acid salts, alkylketene dimers (AKD), and epoxidized fatty acid amides.

Examples of the water-resistance substance include latex emulsions such as styrene-butadiene copolymer, ethylene-vinyl acetate copolymer, polystyrene, and vinylidene chloride copolymer, and polyamidopolyamine-epichlorohydrin.

Examples of the pigment include calcium carbonate, clay, kaolin, talc, barium sulfate, and titanium oxide.

Examples of the pH adjuster include hydrochloric acid, caustic soda, and sodium carbonate.

In addition to the above-described natural pulp paper, examples of other materials for the base paper include synthetic pulp paper, mixed pulps including natural pulp and synthetic pulps, and also various kinds of combined paper pulps.

The base paper thickness is preferably 30 μm to 500 μm, more preferably 50 μm to 300 μm, and even more preferably 70 μm to 200 μm.

(First Layer)

A first layer is present on the base paper of the recording medium in accordance with the invention. By providing the first layer, it is possible to inhibit the penetration of ink solvent into the base paper. For example, paper in which a coating layer having a polyethylene resin as the main component is provided on the base paper surface is well known as paper provided with a solvent blocking layer. However, with the paper provided with the aforementioned solvent blocking layer in order to impart waterproofness thereto, an almost perfect effect can be obtained in preventing the penetration of water, but the feeling of paper is not necessarily satisfactory.

The first layer includes at least a binder and an antistatic agent, wherein the content of the antistatic agent is from 0.2% by mass to 10.0% by mass based on an amount obtained by removing the antistatic agent from all solids in the first layer. A Cobb water absorption degree within a contact time of 120 sec in a water absorption test conforming to JIS P8140 at a surface of the first layer of the base paper provided with the first layer is 2.0 $g/m^2$ or less, and a surface resistivity at 50% RH and 23° C. at a surface of the first layer of the base paper provided with the first layer is equal to $1\times10^{12}\Omega$ or less. The above-described properties are not particularly limited, provided that they are within the aforementioned ranges, and the first layer can be appropriately selected from well-known layers according to the object.

Further, in addition to the binder, the first layer can also include, if necessary, other components such as a white pigment.

From the standpoint of inhibiting the penetration of ink solvent and obtaining good surface properties, it is preferred that the first layer in accordance with the invention use a thermoplastic resin (preferably, a latex, more preferably a polyester urethane latex and an acryl silicone latex) as a binder and kaolin as a white pigment at a ratio x/y of the weight (solids), x, of the thermoplastic resin to the weight, y, of the kaolin equal to or higher than 1 and equal to or lower than 30.

—Binder—

The first layer includes a binder of at least one kind. The binder is used with the object of dispersing and also increasing a coating film strength.

Examples of suitable binders include polyvinyl alcohols (including modified polyvinyl alcohol such as acetoacetyl modified, carboxy modified, itaconic acid modified, maleic acid modified, silica modified, and amino group modified polyvinyl alcohol), methyl cellulose, carboxymethyl cellulose, starch (including modified starch), gelatin, arabic gum, casein, styrene-maleic acid copolymer hydrolyzates, polyacrylamides, and saponified vinyl acetate-polyacrylic acid copolymers. Other examples include latex-type binders of synthetic polymers such as styrene-butadiene copolymer, vinyl acetate copolymers, acrylonitrile-butadiene copolymer, methyl acrylate-butadiene copolymer, and polyvinylidene chloride.

The aforementioned polyvinyl alcohol includes polyvinyl alcohol obtained by saponification of lower alcohol solutions of polyvinyl acetate and derivatives thereof, and also saponification products of copolymers of vinyl acetate and monomers copolymerizable with vinyl acetate. Here, examples of monomers copolymerizable with vinyl acetate include unsaturated carboxylic acids such as (anhydrous) maleic acid, fumaric acid, crotonic acid, itaconic acid and (meth)acrylic acid, esters thereof, α-olefins such as ethylene and propylene, olefinsulfonic acids such as (meth)acrylsulfonic acid, ethylenesulfonic acid, and sulfonic maleate, olefinsulfonic acid alkali metal salts such as sodium (meth)acrylsulfonate, sodium ethylenesulfonate, sodium sulfonate (meth)acrylate, sodium sulfonate (monolakylmaleate), and sodium disulfonate alkyl maleates, amido group-containing monomers such as N-methylolacrylamide and acrylamidealkylsulfonic acid alkali metal salts, and also N-vinyl pyrrolidone derivatives.

Among polyvinyl alcohols, an acetoacetyl modified polyvinyl alcohol typically can be manufactured by adding a liquid or gaseous diketone to a solution, dispersion, or a powder of the polyvinyl alcohol resin and inducing a reaction. The degree of acetylating of the acetoacetyl modified polyvinyl alcohol can be appropriately set according to the target quality, but this degree is preferably 0.1 mol % to 20 mol %, more preferably 0.5 mol % to 10 mol %.

The binder can be also appropriately selected from the well-known thermoplastic resins and latexes thereof, for example, thermoplastic polymers for general use such as polyolefins such as homopolymers of a-olefins such as polyethylene, polypropylene, and polyvinyl chloride or mixtures thereof; polyamides or polyimides; and polyesters such as polyethylene terephthalate; homopolymers of a-methylene aliphatic monocarboxylic acid esters such as methyl (meth) acrylate, ethyl (meth)acrylate, butyl (meth)acrylate, dodecyl (meth)acrylate, octyl (meth)acrylate, and phenyl (meth)acrylate; styrenes such as styrene, chlorostyrene, and vinyl styrene; vinyl esters such as vinyl acetate, vinyl propionate, vinyl benzoate, and vinyl butyrate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone; or any copolymers including these structural units.

Among them, from the standpoint of water shielding ability, thermoplastic resins are preferred and latexes are more preferred. Examples of latexes include latexes of thermoplastic resins such as acrylic latexes, acryl silicone latexes, acryl epoxy latexes, acryl styrene latexes, acryl urethane latexes, styrene-butadiene latexes, acrylonitrile-butadiene latexes, polyester urethane latexes, and vinyl acetate latexes. In particular, from the standpoint of combining ink solvent penetration ability, ability to prevent cockling, cost efficiency and suitability for the manufacturing process, polyester urethane latexes and acryl silicone latexes are preferred.

As for the molecular weight of the latex, a number-average molecular weight of 3,000 to 100,0000 is preferred, and a molecular weight of 5,000 to about 100,000 is more preferred. Where the molecular weight is equal to or higher than 3,000, mechanical strength of the first layer can be ensured, and a molecular weight equal to or less than 100,0000 is advantageous in terms of suitability for the manufacture, such as dispersion stability and viscosity.

More specifically, commercial products can be used as the acrylic latexes. For example, the following water-dispersible latexes can be used. Thus, examples of acrylic resins include Sebian A4635, 46583, 4601 (trade name, produced by Daicel Chemical Industries Co., Ltd.) and Nipol Lx811, 814, 821, 820, 857 (trade name, produced by Japan Zeon Co., Ltd.). Acrylic emulsions (examples of commercial products include Aquabrid Series UM7760, UM7611, UM4901, Acribrid 903, Acribrid Asi-86, Acribrid Asi-89, Acribrid Asi-91, Acribrid Asi-753, Acribrid 4635, Acribrid 4901, Acribrid MSi-04S, Acribrid UA-124, Acribrid AU-131, Acribrid AEA-61, Acribrid AEC-69, and Acribrid AEC-162 (trade names, produced by Daicel Chemical Industries Co., Ltd.)) or acrylic emulsions of acryl silicon latexes described JP-A-Nos. 10-264511, 2000-43409, 2000-343811, and 2002-120452 can be advantageously used.

Examples of commercial products of polyester urethane latexes include HYDRAN AP Series (for example, HYDRAN AP-20, HYDRAN AP-30, HYDRAN AP-30F, HYDRAN AP-40(F), HYDRAN AP-50LM, HYDRAN APX-101H, HYDRAN APX-110, HYDRAN APX-501; trade names, produced by Dainippon Inks & Chemicals Co., Ltd.).

It is preferred that the thermoplastic resins of at least one above-described kind be used, and the thermoplastic resins can be used individually or in combinations of two or more kinds thereof.

The glass transition temperature (Tg) of the thermoplastic resin is preferably within a range of 5° C. to 70° C., more preferably 15° C. to 50° C. Where the Tg is within the aforementioned range, handling in the manufacturing process can be improved, for example, the problem of coagulates of the film forming liquid (for example, coating liquid) for forming the first layer can be resolved and a high gloss and high smoothness can be easily obtained. Thus, where the Tg is too high, the desired gloss cannot be obtained unless a very high calender temperature is set, bonding to the metal roll surface can easily occur, and surface properties are degraded.

Further, the lowest film forming temperature of the thermoplastic resin (preferably resin microparticles of the latex) is preferably 20° C. to 60° C., more preferably 25° C. to 50° C. Where the lowest film forming temperature range in which the film can be formed when the formation of film is desirable is within the aforementioned range, handling in the manufacturing process is facilitated, for example, the problem of coagulates of the film forming liquid (for example, coating liquid) for forming the first layer can be resolved. Furthermore, penetration in the formation of the second layer can be inhibited, coating surface properties of the obtained second layer are improved, and a layer having microporosity sufficient for rapid permeation of ink solvent can be configured. A layer obtained by applying a liquid (for example, a coating liquid) does not necessarily has good gloss, but a high-gloss layer maintaining microporosity can be obtained by subsequently performing a soft calender treatment.

The content of the binder (preferably a thermoplastic resin) in the first layer is preferably 15% by mass to 95% by mass, more preferably 30% by mass to 90% by mass based on the total amount of solids in the first layer. Where the binder content is in this range, good gloss and flatness are obtained when a calender treatment is performed, penetration ability of ink solvent can be obtained, and the occurrence of bleeding with time can be prevented more effectively.

If necessary, an appropriate crosslinking agent for a binder may be added to the first layer correspondingly to the type of the binder.

—Antistatic Agent—

The first layer includes an antistatic agent of at least one kind.

Examples of inorganic antistatic agents include alkali metal salts such as sodium chloride and potassium chloride and alkaline earth metal salts such as calcium chloride and barium chloride. Examples of organic antistatic agents include glycerin-containing or amine-containing antistatic agents such as glycerin fatty acid esters, polyoxyethylene alkylphenyl ethers, alkyldiethanolamines, hydroxyalkylmonoethanolamines, polyoxyethylenealkylamines, polyoxyethylenealkylamine fatty acid esters, and alkyldiethanolamines. Examples of anionic antistatic agents include alkylsulfonates, alkylbenzenesulfonates, alkylphosphates, polyacrylates, polystyrenesulfonates, and polyoleates, examples of cationic antistatic agents include quaternary ammonium salts such as tetraalkylammonium salts and trialkylbenzylammonium salts, and examples of amphoteric antistatic agents include alkylbetaines and alkylimidazoliumbetaines.

Among the above-described antistatic agents, polyacrylates, polymaleates, and polyacryl-maleic acid copolymer salts are usually also used as pigment dispersants. Therefore, they produce no adverse effect on the coating composition and a film that will be coated. In addition, because they contain no chlorine, they are preferred from the standpoint of environmental safety. Accordingly, these compounds are advantageous as the antistatic agent used in accordance with the invention.

From the standpoint of demonstrating the effect of the invention with greater effectiveness, it is preferred that an anionic polymer be used as the antistatic agent.

Among the anionic polymers, polystyrenesulfonates, polyacrylates, polymaleates, and polyacryl-maleic acid copolymer salts are preferred, and polystyrenesulfonates are especially preferred. Sodium polystyrenesulfonate (also represented hereinbelow as "Na polystyrenesulfonate") is especially preferred.

From the standpoint of demonstrating the effect of the invention with greater effectiveness, it is preferred that a cationic polymer be used as the antistatic agent.

Among the cationic polymers, polyoxyethylenealkylamines, polyallylamines, diallylamine hydrochloride polymers, and acrylic cationic polymers are preferred, and acrylic cationic polymers are especially preferred.

From the standpoint of demonstrating the effect of the invention with greater effectiveness, it is preferred that an anionic surfactant be used as the antistatic agent.

Among the anionic surfactants, alkylsulfonates, alkylbenzenesulfonates, alkylphosphates, and alkylphosphoric acid ester salts are preferred, and alkylphosphoric acid ester salts are especially preferred.

From the standpoint of demonstrating the effect of the invention with greater effectiveness, it is preferred that an amphoteric surfactant be used as the antistatic agent.

Among the amphoteric surfactants, alkylbetaines, alkylimidazoliumbetaines, imidazoline-type amphoteric surfactants, amphoteric surfactants of a betaine acetate type, and amidobetaine-type amphoteric surfactants are preferred, and imidazoline-type amphoteric surfactants are especially preferred.

From the standpoint of demonstrating the effect of the invention with greater effectiveness, it is preferred that a cationic surfactant be used as the antistatic agent.

Among the cationic surfactants, quaternary ammonium salts such as tetraalkylammonium salts and trialkylbenzylammonium salts and imidazoline-type cationic surfactants are preferred, and imidazoline-type cationic surfactants are especially preferred.

In accordance with the invention, the content of the antistatic agent in the first layer is from 0.2% by mass to 10.0% by mass based on an amount obtained by removing the antistatic agent from all solids in the first layer.

Where the content of the antistatic agent exceeds 10.0% by mass, the effect of decreasing the surface resistivity is good, but water shielding ability is degraded, the Cobb water absorption degree of the first layer increases, and the desired performance cannot be obtained. Further, where the content of the antistatic agent is less than 0.2% by mass the desired physical properties (for example, the below-described surface resistivity of the first layer surface) cannot be obtained.

From the standpoint of demonstrating the effect of the invention with greater effectiveness, it is preferred that the content of the antistatic agent is from 0.5% by mass to 5.0% by mass.

—Cobb Water Absorption Degree—

In accordance with the invention, a Cobb water absorption degree within a contact time of 120 sec measured in a water absorption test conforming to JIS P8140 from a side of the first layer of the base paper provided with the first layer is 2.0 $g/m^2$ or less. Where the Cobb water absorption degree is made 2.0 $g/m^2$ or less, the base paper provided with the first layer has mild penetration ability, absorption of the applied liquid such as ink can be delayed, and the degree of curling can be reduced.

It is further preferred that the Cobb water absorption degree is 1.0 $g/m^2$ or less. The desirable lower limit value of the Cobb water absorption degree is 0.2 $g/m^2$.

The Cobb water absorption degree is measured by a water absorption test conforming to JIS P8140. In this test, the amount of water absorbed when water comes into contact for a predetermined time from one surface of the base paper, more specifically, from the surface of the first layer of the base paper provided with the first layer. In accordance with the invention, the contact time is 120 sec.

—Surface Resistivity—

In accordance with the invention, the surface resistivity at the first layer surface (the surface of the first layer on the side opposite the surface that is in contact with the base layer) of the base paper provided with the first layer has to be $1\times10^{12}\Omega$ or less.

The surface resistivity in accordance with the invention can be measured by humidifying the base paper after the formation of the first layer (after a coating liquid for forming the first layer has been coated and dried and before the soft calender treatment is performed) for 24 hours under 23° C. and 50% RH environment and then using Highrester UP (trade name, Dia Instrument Inc.).

Otherwise, the surface resistivity in accordance with the invention can be measured by peeling off the second layer with a razor or the like, till the first layer is exposed, or removing the second layer from the recording medium in accordance with the invention by a water washing treatment, humidifying the base paper with the first layer exposed thereon for 24 hours under 23° C. and 50% RH environment and then using Highrester UP (trade name, Dia Instrument Inc.).

In addition to the above-described components, the first layer can use other components such as a white pigment, a hardening agent, and a layered inorganic compound.

—White Pigment—

Examples of the white pigment include titanium oxide, barium sulfate, barium carbonate, calcium carbonate, lithopone, alumina white, zinc oxide, ammonium silica trioxide, titanium phosphate, aluminum hydroxide, kaolin, clay, talc, magnesium oxide, and magnesium hydroxide.

Among them, from the standpoint of water shielding ability, kaolin is preferred. Examples of kaolin include Kaobright 90, Kaogloss, and Kaowhite (trade names, Shiroishi Calcium KK).

Further, from the standpoint of whiteness degree, dispersivity, and stability, titanium oxide is preferred.

Titanium oxide may be of a rutile system and of an anatase type, and these may be used individually or in a mixture. Furthermore, titanium oxide manufactured by a sulfuric acid method or titanium oxide manufactured by a chlorine method may be used. Titanium oxide can be appropriately selected from titanium oxide subjected to a surface coating treatment with an inorganic substance such as a water-containing alumina treatment, a water-containing silicon dioxide treatment, and a zinc oxide treatment, titanium oxide subjected to a surface coating treatment with an organic substance such as trimethylolmethane, trimethylolethane, trimethylolpropane, and 2,4-dihydroxy-2-methylpentane, or titanium oxide treated with a siloxane such as polydimethylsiloxane.

In accordance with the invention, where the first layer includes a white pigment, sticking to a calender during a calender treatment performed after the first layer has been formed can be prevented.

The particle size of the white pigment is preferably 0.2 μm to 3.0 μm. Where the particle size is within this range, whiteness degree and glossiness are improved.

The refractive index of the white pigment is preferably 1.5 or more. Where a white pigment having the refractive index within this range is used, a high-quality image can be formed.

A specific surface area of the white pigment measured by a BET method is preferably less than 100 $m^2/g$. Where a white pigment having the specific surface area within this range is used, penetration of the coating liquid when the second layer is formed by coating can be inhibited and ink absorption ability of the second layer can be improved.

The BET method is one of the methods for measuring the surface area of a powder by a gas-phase adsorption process. This is a method for finding a total surface area of 1 g of sample, that is, a specific surface area, from an adsorption isotherm. In a typical method, nitrogen gas is used as an adsorption gas, and the adsorbed amount is measured from the variation of pressure or volume of the adsorption gas. A Brauner, Emmett, Teller formula (BET formula) represents the isotherm of multimolecular adsorption, the adsorbed amount is found based on this formula, and the surface area is obtained by multiplying on an area occupied by one adsorbed molecule on the surface.

The white pigments can be used individually or in a mixture of two or more thereof.

The content of the white pigment in the first layer differs depending on the type of the white pigment, type of the thermoplastic resin, and layer thickness, but it is usually preferred that this content be about 5% by mass to 200% by mass based on the mass (solids) of the binder.

—Hardening Agent—

The first layer in accordance with the invention may include a hardening agent that hardens the binder. The hardening agent can be selected from aldehyde compounds, 2,3-dihydroxy-1,4-dioxane and derivatives thereof, and compounds having in a single molecule two or more vinyl groups adjacent to a substituent with a positive Hammett substituent constant $\sigma_p$.

Where the first layer includes the hardening agent, waterproofness of the recording medium can be increased, without increasing the viscosity of the film-forming liquid for forming the first layer. As a result, coating stability of the film-forming liquid for forming the first layer increases, and waterproofness of the produced recording medium also increases.

Examples of the substituent with a positive Hammett substituent constant $\sigma_p$ include a $CF_3$ group ($\sigma_p$ value: 0.54), a CN group ($\sigma_p$ value: 0.66), a $COCH_3$ group ($\sigma_p$ value: 0.50), a COOH group ($\sigma_p$ value: 0.45), a COOR (R represents an alkyl group) group ($\sigma_p$ value: 0.45), an $NO_2$ group ($\sigma_p$ value: 0.78), an $OCOCH_3$ group ($\sigma_p$ value: 0.31), an SH group ($\sigma_p$ value: 0.15), an $SOCH_3$ group ($\sigma_p$ value: 0.49), an $SO_2CH_3$ group ($\sigma_p$ value: 0.72), an $SO_2NH_2$ group ($\sigma_p$ value: 0.57), an $SCOCH_3$ group ($\sigma_p$ value: 0.44), an F group ($\sigma_p$ value: 0.06), a Cl group ($\sigma_p$ value: 0.23), a Br group ($\sigma_p$ value: 0.23), an I group ($\sigma_p$ value: 0.18), an $IO_2$ group ($\sigma_p$ value: 0.76), an $N^+(CH_3)_2$ group ($\sigma_p$ value: 0.82), and an $S^+(CH_3)_2$ group ($\sigma_p$ value: 0.90).

Examples of the compound having in a single molecule two or more vinyl groups adjacent to a substituent with a positive Hammett substituent constant $\sigma_p$ include diacrylate and dimethacrylate compounds represented by the following structural formula, such as 2-ethylenesulfonyl-N-[2-(2-ethylenesulfonyl-acetylamino)-ethyl]acetamide, bis-2-vinylsulfonylethylether, bisacryloylimide, N-N'-diacryloylurea, 1,1-bisvinylsulfonethane, and ethylene-bis-acrylamide. Among them, 2-ethylenesulfonyl-N-[2-(2-ethylenesulfonyl-acetylamino)-ethyl]acetamide is especially preferred.

Structural Formula

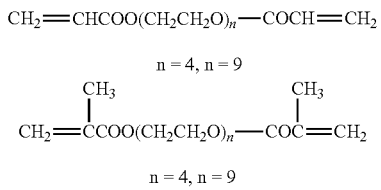

The content of the hardening agent in the first layer is preferably from 0.1% by mass to 30% by mass, more preferably from 0.5% by mass to 10% by mass based on the solids of the binder. Where the content of the hardening agent is within the aforementioned range, the viscosity of the film-forming liquid for forming the first layer is not increased and waterproofness of the recording material can be increased.

—Layered Inorganic Compound—

The first layer may further include a layered inorganic compound. A swelling inorganic layered compound is preferred as the layered inorganic compound, and suitable examples thereof include swelling viscous minerals such as bentonite, hectorite, saponite, videlite, nontronite, stibensite, beidellite, and montmorillonite, swelling synthetic mica, and swelling synthetic smectite. A swelling inorganic layered compound has a layered structure composed of unit crystal lattice layers with a thickness of 1 nm to 1.5 nm, and metal atoms in the lattice are substituted to a degree much higher than that in other clay minerals. As a result, a positive charge insufficiency occurs in the lattice layers, and cations such as $Na^+$, $Ca^{2+}$, and $Mg^{2+}$ are adsorbed between the layers to compensate this insufficiency. Such cations present between the layers are called exchangeable cations and they can be exchanged with various cations. In particular, when the interlayer cations are $Li^+$ and $Na^+$, because the ion radius thereof is small, bonding between the layered crystal lattices is weak and the compound can be greatly swelled by water. Where a shear force is applied in this state, cleaving easily occurs and a stable sol is formed in water. Bentonite and swelling synthetic mica for which this trend is strong are preferred. Water-swelling synthetic mica is especially preferred.

Examples of water-swelling synthetic mica include Na tetrasic mica $NaMg_{2.5}(Si_4O_{10})F_2Na$, Li teniorite $(NaLi)Mg_2(Si_4O_{10})F_2Na$, or Li hectorite $(NaLi)/3Mg_2/3Li_{1/3}Si_4O_{10})F_2$.

As for the size of water-swelling synthetic mica, it is preferred that the thickness be 1 nm to 50 nm and a face size be 1 μm to 20 μm. For control of diffusion, a smaller thickness is preferred, and a larger face size is more preferred within a range in which smoothness and transparency of the coated surface are not degraded. Therefore, the aspect ratio is preferably 100 or more, more preferably 200 or more, and even more preferably 500 or more.

When the water-swelling synthetic mica is used, the mass ratio x/y of the mass (solids), x, of the binder and the mass, y, of the water-swelling synthetic mica in the first layer is preferably within a range from 1 to 30, more preferably within a range from 5 to 15. Where the weight ratio is within this range, a large effect is provided in inhibiting the transmission of oxygen and occurrence of blisters.

The first layer can also contain well-known additives such as an antioxidant.

The thickness of the first layer is preferably within a range of 1 μm to 30 μm, more preferably within a range of 5 μm to 20 μm. Where the thickness of the first layer is within this range, the surface gloss in the subsequently performed calender processing is increased, good whiteness degree can be obtained with a small amount of white pigment, and handleability such as adaptability to bending can be made equivalent to that of the coated paper or art paper.

(Second Layer)

In the recording medium in accordance with the invention, a second layer is further provided on the first layer located on the base paper.

The second layer includes at least a white pigment, and a water absorption amount within a contact time of 0.5 sec determined by a Bristow method at a surface of the second layer is from 2 $mL/m^2$ to 8 $mL/m^2$. The second layer is not particularly limited, provided that the water absorption amount is within this range, and well known compositions can be appropriately selected for the second layer according to the object.

If necessary, the second layer can be configured by further using other components such as a thermoplastic resin.

The second layer in accordance with the invention is, for example, a layer further including a thermoplastic resin, a layer further including a thermoplastic resin in an amount of 10-60 parts by mass of solids per 100 parts by mass of solids of the white pigment, and a layer with a pH of the layer surface 4 or less.

—White Pigment—

The second layer includes a white pigment of at least one kind. By including the white pigment, it is possible to retain the ink (in particular, a pigment contained in the ink) within the second layer and increase the background whiteness degree.

The white pigment is not particularly limited and can be selected from among the white pigments that are typically used for coated paper for printing, such as calcium carbonate, kaolin, titanium dioxide, aluminum oxide trihydroxide, zinc oxide, barium sulfate, satin white, and talc.

Among them, from the standpoint of gloss, kaolin is especially preferred.

Examples of kaolin include Kaobright 90, Kaogloss, and Kaowhite (trade names, Shiroishi Calcium KK).

When an image is formed by applying the recording medium in accordance with the invention to the below-described first or second inkjet recording method in accordance with the invention, that is, when the pH of the layer surface of the second layer is adjusted to an acidic side (preferably to a value 4 or less), or when an ink image is formed using a treatment liquid including the below-described acidic substance, from the standpoint of avoiding image bleeding or color mixing during ink image formation, it is preferred that the content of calcium carbonate be 5% or less by mass, more preferably 1% or less by mass based on the total pigment in the second layer. The case in which no calcium carbonate is contained is even more preferred.

The content of the white pigment in the second layer is preferably 70% to 96% by mass, more preferably 80% to 94% by mass based on the total amount of solids in the second layer.

The preferred range of the particle size of the white pigment contained in the second layer is identical to the preferred range of the particle size of the white pigment that can be contained in the first layer.

—Other Components—

In addition to the above-described components, the second layer may contain other components such as a binder.

The binder is not particularly limited and, for example, the binders that were described hereinabove in reference to the first layer can be used.

—Water Absorption Amount Determined by Bristow Method—

In accordance with the invention, a water absorption amount within a contact time of 0.5 sec determined by a Bristow test at a surface of the second layer is from 2 $mL/m^2$ to 8 $mL/m^2$. Where the water absorption amount is set at 2 $mL/m^2$ to 8 $mL/m^2$, the second layer is mildly permeable, liquid absorption at the application surface when a liquid such as ink is applied is delayed, the degree of curling can be inhibited, and color bleeding and mixing are inhibited. The inhibition of color bleeding and mixing is especially effective when the pH value of the second layer surface is adjusted to acidic (in particular to pH 4 or less), or a treatment liquid including the below-described acidic substrate is used together with the ink, as will be described hereinbelow.

For the same reasons as described hereinabove, it is especially preferred that the water absorption amount in the second layer be within a range from 2 mL/m$^2$ to 4 mL/m$^2$.

The Bristow method is a method that has been used for measuring the amount of absorbed liquid within a short time, and it is also used by the Japan Technical Association of the Pulp and Paper Industry (J. TAPPI). The test method is described in details in J. TAPPI, Methods for Testing Paper and Pulp, No. 51-87, "Method for Testing Liquid Absorption Ability of Paper and Sheet Paper" (Bristow method), Shi-Pa Gikyoshi 41(8), 57-61 (1987). Here, the measurements are conducted by using the test machine (Bristow test machine) described in the aforementioned reference and setting the contact time to 0.5 sec. During the measurements, the head box slit width of the Bristow test is adjusted to match the surface tension of the ink. The aspect of ink penetration to the rear surface of the paper was omitted from the calculations.

—pH—

In the second layer, the pH of the layer surface is preferably adjusted to 4 or less. As a result, the applied ink can be aggregated and fixing of the ink can be improved. Thus, for example, when an ink including a pigment as a coloring component is used, the pigment is aggregated by pH variation when a droplet lands on the second layer and bleeding of the ink with time and color mixing can be inhibited.

Examples of compounds that can be used to obtain an acidic surface of the second layer include compounds having a phosprhoric acid group, a phosphonic group, a phosphinic group, a sulfuric acid group, a sulfonic acid group, a sulfinic acid group, or a carboxylic acid group, or groups derived from salts thereof. It is preferred that a compound having a phosphoric acid group or a carboxylic acid group be used.

Examples of the compound having a phosphoric acid group include phosphoric acid, polyphosphoric acid, derivatives of these compounds, or salts thereof. Examples of the compound having a carboxylic acid group include compounds having a structure of furan, pyrrole, pyrroline, pyrrolidone, pyrone, pyrrole, thiophene, indole, pyridine, or quinoline and also having a carboxyl group as a functional group, or the like, for example, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives of these compounds, salts thereof, or the like.

By adding these compounds to the film forming liquid for forming the second layer, it is possible to adjust the pH to 4 or less. The amount added may be appropriately selected to obtain pH 4 or less.

The pH measurements can be performed by the A method (coating method) from among the methods for measuring the pH of film surface established by the Japan Technical Association of the Pulp and Paper Industry (J. TAPPI). For example, the measurements can be performed by using a pH measurement set for paper surface "Model MPC" manufactured by Kyoritsu Rikagaku Kenkyosho KK, which is equivalent to the A method. With the Model MPC, the measurements are performed by spreading a test liquid over the paper surface and comparing the color thereof with a reference color.

The thickness of the second layer is preferably within a range of 3 μm to 50 μm, more preferably 4 μm to 40 μm. Where the thickness of the second layer is within this range, the texture and stiffness (rigidity) of the recording paper can be maintained.

(Other Layers)

Other layers may be provided in addition to the first layer and second layer on the recording medium in accordance with the invention. The other layers can be appropriately selected according to the object.

<Method for Manufacturing the Recording Medium>

The above-described recording medium in accordance with the invention can be manufactured by any method, provided that a recording medium can be produced that has a layered structure in which the first layer and the second layer are formed on the base paper in this order from the side of the base paper. It is preferred that the recording medium be manufactured by a method (method for manufacturing the recording medium in accordance with the invention) that includes applying a film forming liquid including thermoplastic resin particles and an antistatic agent to a base paper and heat treating within a temperature range equal to and higher than the lowest film forming temperature of the thermoplastic resin particles, thereby forming a first layer in which a content of the antistatic agent is from 0.2% by mass to 10.0% by mass based on an amount obtained by removing the antistatic agent from all solids in the first layer; and forming a second layer by applying a film forming liquid including a white pigment to the first layer.

If necessary, the method for manufacturing the recording medium may contain other processes that are appropriately selected.

—First Forming Process—

In the first forming process, a film forming liquid (film forming liquid for forming the first layer) including thermoplastic resin particles and an antistatic agent is applied to a base paper and heat treated within a temperature range equal to and higher than the lowest film forming temperature of the thermoplastic resin particles, thereby forming a first layer in which a content of the antistatic agent is from 0.2% by mass to 10.0% by mass based on an amount obtained by removing the antistatic agent from all solids in the first layer. A pressure may be applied in the heat treatment.

Details relating to the base paper are same as those described hereinabove with reference to the first layer, and the preferred aspects are also the same. The thermoplastic resin and particles thereof can be identical to the thermoplastic resins and latexes thereof that can be used in the above-described first layer, and no particular limitation is placed thereupon. The thermoplastic resin particles of one kind may be used individually, or a combination of two or more kinds may be used. Details relating to the antistatic agent are same as those described hereinabove with reference to the first layer, and the preferred aspects are also the same.

Thermoplastic resin particles with a mean particle size of 10 nm to 200 nm are preferred. The mean particle size of the thermoplastic resin particles is a value measured by a dynamic light scattering method (apparatus name: ELS-800, manufactured by Otsuke Denshi KK).

The thermoplastic resin constituting the thermoplastic resin particles preferably has a maximum film forming temperature (MFT) of 5° C. to 60° C.

The coating amount of the thermoplastic resin is preferably 1 g/m$^2$ to 30 g/m$^2$.

From the standpoint of inhibiting cockling, improving bleeding with time, and ensuring suitability of the manufacturing process, it is preferred that dispersed particles of a water-dispersible latex be dispersed as the thermoplastic resin particles. In a water-dispersible latex, a hydrophobic polymer that is insoluble or hardly soluble in water is dispersed in the form of fine particles in a water-phase dispersion medium. The dispersed state includes that of a polymer emulsified in a dispersion medium, an emulsion polymerized polymer, a micelle dispersion, and a polymer having a hydrophilic structure in a part of its molecule so that that the molecular chain itself is dispersed in the molecular form. Such water-dispersible latexes are described in Okuda and Inagaki, Ed., "Synthetic Resin Emulsion" (Kobunshi Kankokai, 1978); Sugimura, Kataoka, Suzuki, and Kasahara Ed., "Applications of Synthetic Latexes" (Kobunshi Kankokai, 1993); and Muroi, "Chemistry of Synthetic Latexes" (Kobunshi Kankokai, 1970).

More specifically, a latex of at least one kind can be selected as the water-dispersible latex from a polyether urethane latex, an acrylic latex, an acryl silicone latex, an acrylepoxy latex, an acrylstyrene latex, an acrylurethane latex, a styrene-butadiene latex, an acrylonitrile-butadiene latex, and a vinyl acetate latex.

The molecular weight of the water-soluble latex, as represents by a weight-average molecular weight, is preferably 3,000 to 100,000, more preferably 5,000 to 100,000. Where the molecular weight is 3,000 or more, the mechanical strength of the first layer can be ensured, and the molecular weight 1000,000 or less is preferred from the standpoint of suitability for production, such as dispersion stability and viscosity.

Among the above-described latexes, from the standpoint of ink solvent penetration ability, high cockling inhibition effect, cost efficiency, and suitability for manufacture, it is preferred that one, or two or more latexes selected from polyester urethane latexes and acryl silicone latex be used in the first layer.

A method for applying the film forming liquid for forming the first layer is not particularly limited, provided it can form the film. For example, the application can be performed by any well-known method such as a coating method, an inkjet method, and a dipping method, but from the standpoint of film surface smoothness after the film has been formed, it is preferred that a coating method be used that employs the film forming liquid for forming the first layer as a coating liquid.

Well-known coating methods can be appropriately employed for coating. Examples of well-known coating methods include a blade coating method, a slide bead method, a curtain method, an extrusion method, an air knife method, a roll coating method, and a metering bar coating method.

After the coating, the coating film formed by coating is heat treated within a temperature range above the lowest film forming temperature of the thermoplastic resin. The heat treatment may be also performed to serve as a drying treatment after the coating, or these two processes may be performed separately. The heat treatment can be performed by a method including introducing the film into an oven at a temperature equal to or higher than the lowest film forming temperature and blowing dry air at a temperature equal to or higher than the lowest film forming temperature.

—Second Forming Process—

In the second forming process, a film forming liquid including a white pigment (film forming liquid for forming the second layer) is applied onto the first layer that has been formed in the first forming process and a second layer is formed. Features other than the formation of the second layer on the first layer are not particularly limited and can be appropriately selected according to the object.

Details relating to the white pigment in the film forming liquid for forming the second layer are same as those described hereinabove with reference to the second layer, and the preferred aspects are also the same.

A method for applying the film forming film for forming the second layer is not particularly limited, provided that a film can be formed. For example, any well-known method such as a coating method, an inkjet method, and a dipping method can be used. From the standpoint of obtaining a smooth film surface having high gloss after coating, a coating method using the coating liquid for forming the second layer as a coating liquid is preferred.

Well-known coating methods can be appropriately employed for coating. Examples of well-known coating methods include a blade coating method (a vent method, a bevel method), a slide bead method, a curtain method, an extrusion method, an air knife method, a roll coating method, and a metering bar coating method. Among them, a blade coating method is preferred because it enables high-speed coating and makes it possible to obtain gloss, e.g., by enhancing the orientation of pigment, for example, when a flat-plate pigment such as a layered inorganic compound is used. Further, in the blade coating method, a comparatively large shear stress is generated at a moment of scraping. Therefore, a large amount of water is easily moved into the paper support body by pressure-induced permeation caused by an instantaneous nip pressure, and this is especially effective in application to the recording medium in accordance with the invention that has the first layer blocking the permeation of solvent.

In addition to the above-described processes, other processes may be provided without any special limitation. Other processes can be appropriately selected according to the object.

<Inkjet Recording Method>

The inkjet recording method in accordance with the invention includes an ink image forming process in which an ink is applied to the above-described recording medium in accordance with the invention and an ink image is formed correspondingly to the predetermined image data and a drying and removing process in which the ink solvent in the recording medium upon which the ink image has been formed is dried and removed.

Figure 2:
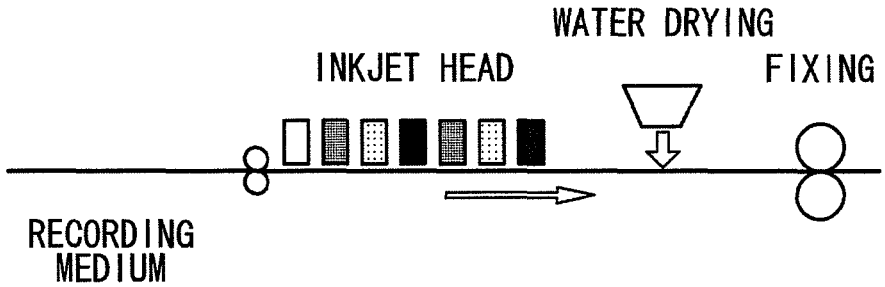
FIG. 2 is an explanatory drawing serving to explain an example of an inkjet recording method of the first embodiment using the recording medium in accordance with the invention.
Figure 3:
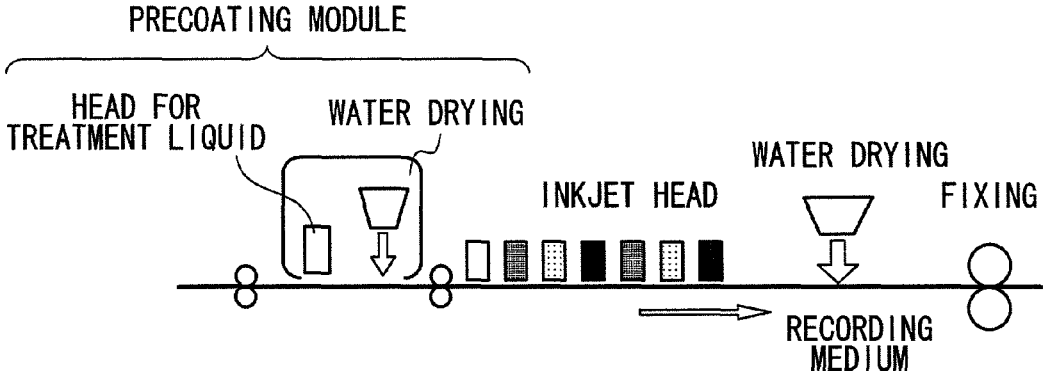
FIG. 3 is an explanatory drawing serving to explain an example of an inkjet recording method of the second embodiment using the recording medium in accordance with the invention.

The inkjet recording method in accordance with the invention can be performed by an inkjet recording method by which ink image formation or the like is performed with respect to a recording medium on which the pH of the layer surface has been decreased by introducing in advance an aggregating agent (treatment liquid) into the second layer (coat layer on the first layer) in the above-described recording medium in accordance with the invention (see FIG. 2; this method will be referred to hereinbelow as "inkjet forming method according to the first aspect"), and an inkjet recording method by which ink image formation is performed after supplying a treatment liquid including an acidic substance (precoating) on the above-described recording medium in accordance with the invention (see FIG. 3; this method will be referred to hereinbelow as "inkjet forming method according to the second aspect").

The inkjet recording method according to the first aspect of the invention includes an ink image forming process in which an ink is applied to the recording medium in accordance with the invention in which the pH of the second layer surface has been adjusted to 4 or less and an ink image is formed according to the predetermined image data and a drying and removing process in which the ink solvent in the recording medium on which the ink image has been formed is dried and removed.

The inkjet recording method according to the second aspect of the invention includes a treatment liquid supply process in which a treatment liquid including an acidic substance is supplied to the above-described recording medium in accordance with the invention, an ink image forming process in which an ink is applied to the recording medium to which the treatment liquid has been supplied and an ink image is formed correspondingly to the predetermined image data, and a drying and removing process in which the ink solvent in the recording medium on which the ink image has been formed is dried and removed.

The above-described inkjet recording methods according to the first and second aspects may include, if necessary, other appropriately selected processes.

—Ink Image Forming Process—

In the ink image forming process of the first aspect, a recording medium in accordance with the invention in which the pH of the second layer surface has been adjusted to 4 or less, from among the above-described recording media in accordance with the invention, is used and an ink is applied to the second layer of the recording medium, thereby forming an ink image correspondingly to the predetermined image data. Where an ink (for example, a pigment ink) is applied to the second layer, the ink (for example, the pigment contained in the ink) is aggregated by pH changes during droplet landing, thereby inhibiting ink bleeding and color mixing.

In the ink image forming process according to the second aspect, as in the first aspect, an ink is applied to the recording medium onto which a treatment liquid has been supplied in the below-described treatment liquid supply process, while adjusting the pH of the second layer surface to 4 or less, or without such an adjustment, thereby forming an ink image correspondingly to the predetermined image data. According to the second aspect, at acidic state (preferably a state with a pH 4 or less) is assumed on at least part of the second layer under the effect of the treatment liquid that has been supplied to the second layer prior to ink application or simultaneously therewith, and the ink applied therein (for example, a pigment ink) is aggregated (for example, pigment in the ink) owing to pH changes during droplet landing, thereby inhibiting ink bleeding and color mixing.

The ink image forming process is not particularly limited, provided that an image is formed by applying ink correspondingly to the predetermined image data, and can be appropriately selected according to the object. For example, an ink image can be formed by ejecting ink by an inkjet method. The inkjet recording method is not particularly limited and, for example, the following methods can be used: a charge control method in which an ink is ejected by using an electrostatic attraction force, a drop-on-demand method (pressure pulse method) using an oscillation pressure of a piezo element, an acoustic inkjet method in which an electric signal is converted into an acoustic beam, an ink is irradiated therewith, and the ink is ejected using the radiation pressure, and a thermal inkjet method in which bubbles are formed by heating an ink and the generated pressure is used. The aforementioned inkjet recording methods include a method in which an ink with a low concentration called "photoink" is ejected in a large number of small volumes, a method by which image quality is improved by using a plurality of inks of substantially identical hue and different density, and a method using a colorless transparent ink.

Among the above-described methods, a drop-on-demand method (pressure pulse method) using a piezo element is preferred.

—Treatment Liquid Supply Process—

With the inkjet recording method according to the second aspect, a treatment liquid supply process is implemented before the ink image forming process and a treatment liquid including an acidic substance is supplied in advance to the second layer of the recording medium. The treatment liquid supply process is not particularly limited, provided that the below-described treatment liquid including acidic substrates is supplied, and can be appropriately selected according to the object. If necessary, the treatment liquid supply process may be provided in the inkjet recording method according to the first aspect.

(Treatment Liquid)

The treatment liquid including an acidic substance may be a liquid prepared so as to include an acidic substance and have liquid properties on the acidic side. The treatment liquid is preferably an aqueous liquid in which an acidic substance is mixed with an aqueous medium. From the standpoint of inhibiting ink bleeding and color mixing, the pH value of the treatment liquid in accordance with the invention is preferably equal to or less than 4.

Examples of suitable acidic substances for imparting acidic properties to the treatment liquid include compounds having a phosphoric acid group, a phosphonic acid group, a phosphinic acid group, a sulfuric acid group, a sulfonic acid group, a sulfinic acid group, a carboxylic acid group, or groups derived from salts thereof. Compounds having a phosphoric acid group and a carboxylic acid group are preferred, and compounds having a carboxylic acid group are more preferred.

Examples of the compound having a phosphoric acid group include phosphoric acid, polyphosphoric acid, derivatives of these compounds, and salts thereof. Examples of the compound having a carboxylic acid group include compounds having a structure of furan, pyrrole, pyrroline, pyrrolidone, pyrone, thiophene, indole, pyridine, or quinoline and also having a carboxyl group as a functional group, or the like, for example, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives of these compounds, salts thereof, or the like.

Pyrrolidone carboxylic acid, pyrone carboxylic acid, furan carboxylic acid, coumaric acid, derivatives of these compounds, and salts thereof are preferred as the acidic substance. The acidic substance of one kind or a combination of two or more kinds thereof may be used.

Other additives may be also included in the treatment liquid within ranges that do not degrade the effect of the invention.

Examples of other additives include well-known additives such as drying inhibitors (humidifying agents), fading preventing agents, emulsion stabilizers, penetration enhancers, ultraviolet absorbents, preservatives, fungicides, pH adjusters, surface tension adjusters, antifoaming agents, viscosity adjusters, dispersants, dispersion stabilizers, antirust agents, and chelating agents.

The treatment liquid may be supplied to the entire recording surface of the recording medium, or may be supplied at least to part of the recording surface, for example, correspondingly to the predetermined image data. A method for supplying the treatment liquid is not particularly limited, and a coating method, an inkjet method, and a dipping method can be used. For example, the treatment liquid may be supplied by ejection with the inkjet method.

With the inkjet recording method according to the second embodiment, an image may be formed using aqueous two-liquid aggregation ink described below.

—Drying and Removal Process—

The drying and removal process is performed to dry and remove the ink solvent contained in the recording medium on which the ink image has been formed. This process is not particularly limited, provided that the ink solvent of the ink applied to the recording medium is dried and removed, and the appropriate process can be selected according to the object.

Because the coat layer serving as the second layer in the recording medium in accordance with the invention is mildly permeable, the drying and removal process is implemented in a state in which the ink solvent, in particular water, is present close to the surface of the recording medium. The drying and removal my be performed, for example, by a method of blowing the dry air of a predetermined temperature and a method of passing the recording medium between a pair of rolls that are heated and/or pressed together.

—Other Processes—

The inkjet recording method in accordance with the invention may include other processes in addition to the above-described processes. Other processes are not particularly limited and can be appropriately selected according to the object. For example, heating and fixing process can be implemented.

In the inkjet recording method in accordance with the invention, for example, a heating and fixing process in which the latex particles contained in the ink used in the inkjet recording method are melted and fixed can be provided after the drying and removal process. With the heating and fixing process, the fixing ability of the ink to the recording medium can be increased. The heating and fixing process is nor particularly limited, provided that the latex particles are melted and fixed as mentioned hereinabove, and the process can be appropriately selected according to the object.

—Implementation Example of First Inkjet Recording Method—

The first inkjet recording method, for example, includes ink image formation, drying (water drying, flow drying), and heating and fixing implemented under the following conditions.

<Ink Image Formation>

Head: full-line head having a width of 1,200 dpi/20 inch.

Volume of ejected liquid droplet: four-value recording at 0, 2.0, 3.5, and 4.0 pL.

Drive frequency: 30 kHz (conveying speed of recording medium 635 mm/sec).

<Drying (Water Drying, Blow Drying)>

Blower speed: 8 m/sec to 15 m/sec.

Temperature: 40° C. to 80° C.

Blowing range: 640 mm (drying time 1 sec).

<Heating and Fixing>

Silicone rubber roller (hardness 50°, nip width 5 mm)

Roller temperature: 70° C. to 90° C.

Pressure: 0.5 MPa to 2.0 MPa.

—Implementation Example of Second Inkjet Recording Method—

The second inkjet recording method, for example, includes precoating, ink image formation, drying (water drying, flow drying), and heating and fixing implemented under the following conditions.

<Head for Treatment Liquid for Precoat Module>

Head: full-line heave with a width of 600 dpi/20 inch.

Volume of ejected liquid droplet: two-value recording at 0 and 4.0 pL.

Drive frequency: 15 kHz (conveying speed of recording medium 635 mm/sec).

Image formation pattern: a pattern is employed such that a treatment liquid is applied in advance to a position where an image will be formed with a colored ink of at least one color in the ink image formation process.

<Water Drying for Precoat Module (Blowing Conditions)>

Blower speed: 8 m/sec to 15 m/sec.

Temperature: 40° C. to 80° C.

Blowing zone: 450 mm (drying time 0.7 sec).

<Ink Image Formation>

Head: full-line head with a width of 1,200 dpi/20 inch.

Volume of ejected liquid droplet: four-value recording at 0, 2.0, 3.5, and 4.0 pL.

Drive frequency: 30 kHz (conveying speed of recording medium 635 mm/sec).

<Drying (Water Drying, Blow Drying)>

Blower speed: 8 m/sec to 15 m/sec.

Temperature: 40° C. to 80° C.

Blowing zone: 640 mm (drying time 1 sec).

<Heating and Fixing>

Silicone rubber roll (hardness 50°, nip width 5 mm).

Roller temperature: 70° C. to 90° C.

Pressure: 0.5 MPa to 2.0 MPa.

—Aqueous Two-Liquid Aggregation Ink—

The inkjet recording method according to the above-described second aspect may use an aqueous two-liquid aggregation ink composed of a treatment liquid and an ink that aggregates upon reacting with the treatment liquid.

A liquid identical to the above-described treatment liquid can be used as the treatment liquid of the aqueous two-liquid aggregation ink. Details relating to the treatment liquid are explained hereinabove.

—Ink—

The ink constituting the aqueous two-liquid aggregation ink can be used not only for forming a monochromatic image, but also for forming a full-color image. A magenta color tone ink, a cyan color tone ink, and a yellow color tone ink can be used to form a full-color image. Further, a black color tone ink may be also used to adjust the color tone. In addition to the yellow, magenta, and cyan color tone inks, special inks, such as a red ink, a green ink, a blue ink, a white ink, and the so-called special inks (example colorless ink) of the printing field can be used. Further, a composition including, for example, latex particles, an organic pigment, a dispersant, and a water-soluble organic solvent and also, if necessary, other additives, can be also used as the ink.

<Latex Particles>

Particles of a polymer of a compound composed, for example, of a nonionic monomer, an anionic monomer, and a cationic monomer that are dispersed in an aqueous medium can be used as the latex particles.

The nonionic monomer is a monomer compound that has no dissociative functional groups. The monomer compound as referred to herein, in a wide meaning thereof, represents a single compound or a compound obtained by polymerization with another compound. The monomer compound is preferably a monomer compound having an unsaturated double bond.

The anionic monomer is a monomer compound including an anionic group that can bear a negative electric charge. Any anionic group may be employed, provided that it has a negative electric charge. The anionic group is preferably a phosphoric acid group, a phosphonic acid group, a phosphinic acid group, a sulfuric acid group, a sulfonic acid group, a sulfinic acid group, or a carboxylic acid group, more preferably a phosphoric acid group and a carboxylic acid group, and even more preferably a carboxylic acid group.

The cationic monomer as referred to herein is a monomer including a cationic group that can bear a positive electric charge. The cationic group may be any group, provided that it has a positive electric charge, but an organic cationic substituent is preferred, and a cationic group of nitrogen or phosphorus more preferred. Further, a pyridinium cation or ammonium cation is even more preferred.

<Organic Pigments>

Examples of orange or yellow organic pigments include C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 128, C. I. Pigment Yellow 138, C. I. Pigment Yellow 151, C. I. Pigment Yellow 155, C. I. Pigment Yellow 180, and C. I. Pigment Yellow 185.

Examples of magenta or red organic pigments include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 222, and C. I. Pigment Violet 19.

Examples of green or cyan organic pigments include C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Green 7, and siloxane-crosslinked aluminum phthalocyanine described in U.S. Pat. No. 4,311,775.

Examples of black organic pigments include C. I. Pigment Black 1, C. I. Pigment Black 6, and C. I. Pigment Black 7.

From the standpoint of transparency and color reproducibility, a small average particle size of the organic pigment is preferred, but from the standpoint of light fastness, a large mean particle size is preferred. A size of 10 nm to 200 nm, more preferably 10 nm to 150 nm, and even more preferably 10 nm to 100 nm is a mean particle size that meets both requirements. Further, the particle size distribution of the organic pigment is not particularly limited, and both the organic pigment with a wide particle size distribution and an organic pigment with a monodisperse particle size distribution may be used. The organic pigments having a monodisperse particle size distribution may be used in a mixture of two or more kinds thereof.

The amount of the organic pigment added to the ink is preferably 1% to 25% by mass, more preferably 2% to 20% by mass, still more preferably 5% to 20% by mass, and particularly preferably 5% to 15% by mass.

<Dispersant>

A polymer dispersant or a low-molecular surfactant-type dispersant may be used as the dispersant for the organic pigment. Further, the polymer dispersant may be water soluble or water insoluble.

The low-molecular surfactant-type dispersant is added with the object dispersing the organic pigment in an aqueous solvent with good stability, while maintaining a low viscosity of the ink. The low-molecular dispersant has a molecular weight equal to or lower than 2,000. The molecular weight of the low-molecular dispersant is preferably 100 to 2,000, more preferably 200 to 2,000.

The low-molecular dispersant has a structure including a hydrophilic group and a hydrophobic group. The hydrophilic group and hydrophobic group may be contained at a ratio of one or more of each of them per one molecule. The hydrophilic groups and hydrophobic groups of a plurality of kinds may be also contained. A linking group that links the hydrophilic group and hydrophobic group can be also appropriately contained.

The hydrophilic group is an anionic, cationic, nonionic, or a betaine group combined them.

The anionic group may be of any kind, provided that it bears a negative electric charge. The anionic group is preferably a phosphoric acid group, a phosphonic acid group, a phosphinic acid group, a sulfuric acid groups, a sulfonic acid group, a sulfinic acid group, or a carboxylic acid group, more preferably a phosphoric acid group and a carboxylic acid group, and even more preferably a carboxylic acid group.

The cationic group may be of any kind, provided that it bears a positive electric charge. The cationic group is preferably an organic cationic substituent, more preferably a nitrogen or phosphorus cationic group. Further, a pyridinium cation or an ammonium cation is even more preferred.

Examples of the nonionic group include polyethylene oxide, polyglycerin, and parts of sugar units.

The hydrophilic group is preferably an anionic group. The anionic group is preferably a phosphoric acid group, a phosphonic acid group, a phosphinic acid group, a sulfuric acid groups, a sulfonic acid group, a sulfinic acid group, or a carboxylic acid group, more preferably a phosphoric acid group and a carboxylic acid group, and even more preferably a carboxylic acid group.

When the low-molecular dispersant has an anionic hydrophilic group, from the standpoint of enhancing the aggregation reaction proceeding in contact with an acidic treatment liquid, it is preferred that pKa is 3 or more. The pKa of the low-molecular dispersant in accordance with the invention is a value obtained empirically from a titration curve obtained by dissolving a low-molecular dispersant at 1 mmol/L in a tetrahydrofuran-water solution (3:2=V/V), and titrating the solution with an acidic or alkaline aqueous solution. Where the pKa of the low-molecular dispersant is equal to or higher than 3, theoretically 50% or more of anionic groups assume a non-dissociative state in contact with a treatment liquid with a pH of about 3. Therefore, water solubility of the low-molecular dispersant decreases significantly and an aggregation reaction occurs. Thus, aggregation reactivity increases. From this standpoint, too, it is preferred that the low-molecular dispersant include a carboxylic acid group as the anionic group.

The hydrophobic group has a structure of a hydrocarbon system, a fluorinated carbon system, a silicone system, and the like, but the hydrophobic group of a hydrocarbon system is especially preferred. Further, the hydrophobic group may have a linear or branched structure. The hydrophobic group may have one chain structure, or two or more chain structures, and when it has two or more chain structures, hydrophobic groups of a plurality of kinds may be contained.

The hydrophobic group is preferably a hydrocarbon group having 2 to 24 carbon atoms, more preferably a hydrocarbon group having 4 to 24 carbon atoms, and even more preferably a hydrocarbon group having 6 to 20 carbon atoms.

From among the polymer dispersants, a hydrophilic polymer compound can be used as water-soluble dispersant. Examples of natural hydrophilic polymer compounds include plant-based polymers such as gum arabic, tragacanth gum, gua gum, karaya gum, locust bean gum, arabinogalacton, pectin, and queens seed starch, seaweed polymers such as alginic acid, carrageenan, and agar-agar, animal polymers such as gelatin, casein, albumin, and collagen, and microbial polymers such as xanthene gum and dextran.

Examples of hydrophilic polymer compounds employing natural products as starting materials include fibrous polymers such as methyl cellulose, ethyl cellulose, hydroxyethyl cellulose, hydroxypropyl cellulose, and carboxymethyl cellulose, starch polymers such as sodium starch glycolate, starch phosphoric acid ester sodium, and seaweed polymers such as sodium alginate and alginic acid propylene glycol ester.

Examples of synthetic water-soluble polymer compounds include vinyl polymers such as polyvinyl alcohol, polyvinyl pyrrolidone, and polyvinylmethyl ether, acrylic resins such as non-crosslinked polyacrylamide, polyacrylic acid or alkali metal salts thereof, and water-soluble styrene acrylic resins, water-soluble styrene-maleic acid resins, water-soluble vinyl naphthalene acrylic resins, water-soluble vinyl naphthalene maleic acid resins, polyvinyl pyrrolidone, polyvinyl alcohol, β-naphthalenesulfonic acid formalin condensate alkali metal salts, polymers having a salt of a cationic functional group such as quaternary ammonium or amino group in a side chain, and natural polymer compounds such as shellac.

Among them, compounds having a carboxyl group introduced therein that are composed of homopolymers of acrylic acid, methacrylic acid, and styrene-acrylic acid, or of copolymers with other monomers having hydrophilic groups are especially preferred as the polymer dispersant.

Among polymer dispersants, a polymer having a hydrophobic portion and a hydrophilic portion can be used as a water-insoluble dispersant. Examples of such polymers include styrene-(meth)acrylic acid copolymer, styrene-(meth)acrylic acid-(meth)acrylic acid ester copolymer, (meth)acrylic acid ester-(meth)acrylic acid copolymer, polyethylene glycol (meth)acrylate-(meth)acrylic acid copolymer, vinyl acetate-maleic acid copolymer, and styrene maleic acid copolymer.

The weight-average molecular weight of the dispersant is preferably 3,000 to 100,000, more preferably 5,000 to 50,000, even more preferably 5,000 to 40,000, and still more preferably 10,000 to 40,000.

The mixing weight ratio of the organic pigment and dispersant is preferably within a range of 1:0.06 to 1:3, more preferably 1:0.125 to 1:2, and even more preferably 1:0.125 to 1:1.5.

<Water-Soluble Organic Solvent>

The water-soluble organic solvent is used with the object of preventing drying and enhancing wetting.

The water-soluble organic solvent serving as a drying inhibitor can be advantageously used in an ink ejection orifice of a nozzle in the inkjet recording system in order to prevent clogging by the dried inkjet ink.

A water-soluble organic solvent with a vapor pressure lower than that of water is preferred as a drying inhibitor. Specific examples of such drying inhibitors include polyhydric alcohols such as ethylene glycol, propylene glycol, diethylene glycol, polyethylene glycol, thiodiglycol, dithiodiglycol, 2-methyl-1,3-propanediol, 1,2,6-hexanetriol, acetylene glycol derivatives, glycerin, and trimethylolpropane, lower alkyl ethers of polyhydric alcohols, such as ethylene glycol monomethyl (or ethyl) ether, diethylene glycol monomethyl (or ethyl) ether, and triethylene glycol monomethyl (or butyl) ether, hetero rings such as 2-pyrrolidone, N-methyl-2-pyrrolidone, 1,3-dimethyl-2-imidazolidinone, and N-ethyl morpholine, sulfur-containing compounds such as sulfolan, dimethylsulfoxide, and 3-sulfolene, polyfunctional compounds such as diacetone alcohol and diethanolamine, and urea derivatives. Among them, polyhydric alcohols such as glycerin and diethylene glycol are preferred as the drying inhibitor. Further, the aforementioned drying inhibitors may be used individually or in combinations of two or more thereof. The content of these drying inhibitors in the ink is preferably from 10.% to 15% by mass.

The water-soluble organic solvent serving as a penetration-enhancing agent can be advantageously used with the object of causing more efficient penetration of the ink into the recording medium (recoding paper). Specific examples of the penetration-enhancing agent that can be advantageously used include alcohols such as ethanol, isopropanol, butanol, di(tri) ethylene glycol monobutyl ether, and 1,2-hexanediol, sodium lauryl sulfate and sodium oleate, and nonionic surfactants. Where penetration-enhancing agents are contained at a content ratio of 5.% to 30% by mass in the ink composition, a sufficient effect is demonstrated. It is preferred that the penetration-enhancing agent be added in an amount within a range that causes no image bleeding or print-through.

In addition to the above-described objects, a water-soluble organic solvent can be also used for adjusting viscosity. Specific examples of water-soluble organic solvents that can be used to adjust viscosity include alcohols (for example, methanol, ethanol, propanol, isopropanol, butanol, isobutanol, sec-butanol, t-butanol, heptanol, hexanol, cyclohexanol, and benzyl alcohol), polyhydric alcohols (for example, ethylene glycol, diethylene glycol, triethylene glycol, polyethylene glycol, propylene glycol, dipropylene glycol, polypropylene glycol, butylene glycol, hexanediol, pentane diol, glycerin, hexanetriol, and thiodiglycol), glycol derivatives (for example, ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, and ethylene glycol monophenyl ether), amines (for example, ethanolamine, diethanolamine, triethanolamine, N-methyldiethanolamine, N-ethyldiethanolamine, morpholine, N-ethylmorpholine, ethylenediamine, diethylenetrimaine, triethylenetetramine, polyethyleneimine, and tetramethyl propylenediamine), and other polar solvents (for example, formamide, N,N-dimethylformamide, N,N-dimethylacetamide, dimethylsulfoxide, sulfolan, 2-pyrrolidone, N-methyl-2-pyrrolidone, N-vinyl-2-pyrrolidone, 2-oxazolidone, 1,3-dimethyl-2-imidazolidinone, acetonitrile, and acetone). The water-soluble organic solvents may be used individually or in combinations of two or more thereof.

<Other Additives>

Examples of other additives include well-known additives such as drying inhibitors (humidifying agents), fading preventing agents, emulsion stabilizers, penetration enhancers, ultraviolet absorbers, preservatives, fungicides, pH adjusters, surface tension adjusters, antifoaming agents, viscosity adjusters, dispersants, dispersion stabilizers, antirust agents, and chelating agents. In the case of a water-soluble ink, these additives are directly added to the ink. When an oil-soluble dye is used in the form of a dispersion, the additives are typically added to the dispersion after the dye dispersion has been prepared, but they may be also added to the oil phase or water phase during preparation.

Ultraviolet absorbers are used with the object of improving image storability. Examples of ultraviolet absorbers include benzotriazole compounds described in JP-A Nos. 58-185677, 61-190537, 2-782, 5-197075, and 9-34057, benzophenone compounds described in JP-A Nos. 46-2784 and 5-194483 and U.S. Pat. No. 3,214,463, cinnamic acid compounds described in JP-B Nos. 48-30492 and 56-21141 and JP-A No. 10-88106, triazine compounds described in JP-A Nos. 4-298503, 8-53427, 8-239368 and 10-182621 and JP-W No. 8-501291, compounds that emit fluorescence on absorption of ultraviolet radiation, such as compounds described in Research Disclosure No. 24239, stilbene compounds, and benzoxazole compounds, and the so-called fluorescent whitening agents.

Fading preventing agents are used with the object of improving image storability. Fading preventing agents of a variety of organic systems and metal complex systems can be used as the fading preventing agent. Examples of organic fading preventing agents include hydroquinones, alkoxyphenols, dialkoxyphenols, phenols, anilines, amines, indanes, coumarones, alkoxyanilines, and hetero rings. Examples of metal complexes include nickel complexes and zinc complexes. More specific examples include compounds describes in patent documents cited in Research Disclosure No. 17643, Pages VII-I to J, Research Disclosure No. 15162, Research Disclosure No. 18716, page 650, left column, Research Disclosure No. 36544, page 527, Research Disclosure No. 307105, page 872, and Research Disclosure No. 15162, and also compounds included in compound examples and formulas of representative compounds described in JP-A No. 62-215272, pages 127-137.

Examples of fungicides include sodium dehydroacetate, sodium benzoate, sodium pyridinethione-1-oxide, ethyl p-hyroxybenzoate, and 1,2-benzisothiazoline-3-one. These compounds are preferably used in the ink in an amount of 0.02% to 1.00% by mass.

A neutralizer (organic base, inorganic alkali) can be used as the pH adjuster. The pH adjuster is used to increase storage stability of the inkjet ink. The adjuster is preferably added so that the inkjet ink has pH 6 to 10, more preferably pH 7 to 10.

Examples of the surface tension adjuster include nonionic surfactants, cationic surfactants, anionic surfactants, and betaine surfactants.

The amount of the surface tension adjuster added to the ink is preferably such as to adjust ink surface tension to 20 mN/m to 60 mN/m, preferably to 20 mN/m to 45 mN/m, and more preferably to 25 mN/m to 40 mN/m, to that the ink droplets can be effectively ejected in inkjet printing.

Specific examples of the surfactants of a hydrocarbon system include anionic surfactants such as fatty acid salts, alkylsulfates, alkylbenzenesulfonates, alkylnaphthalenesulfonates, dialkylsulfosuccinates, alkylphosphates, naphthalenesulfonic acid formalin condensate, and polyoxyethylenealkylsulfates; nonionic surfactants such as polyoxyethylene alkyl ethers, polyoxyethylene alkyl allyl ethers, polyoxyethylene fatty acid esters, sorbitan fatty acid esters, polyoxyethylene sorbitan fatty acid esters, polyoxyethylene alkylamines, glycerin fatty acid esters, and oxyethylene oxypropylene block copolymers. It is also preferable to use SURFYNOLS (trade name, Air Products & Chemicals Co.), which is an acetylene-type polyoxyethylene oxide surfactant, or amineoxide-type amphoteric surfactants such as N,N-dimethyl-N-alkylamineoxide.

Surfactants described in JP-A No. 59-157636, pp. 37-38, and Research Disclosure No. 308119 (1989) can be also used.

Abrasion resistance can be improved by using fluorine (fluorinated alkyl) surfactants and silicone surfactants such as described in JP-A Nos. 2003-322926, 2004-325707, and 2004-309806.

These surface tension adjusters can be also used as antifoaming agents, and chelating agents such as fluorine compounds, silicone compounds, and EDTA can be also used.

EXAMPLES

The invention will be described below in greater details based on examples thereof, but the invention is not limited to the below-described examples and can be modified, without departing from the essence thereof.

The terms "parts" and "%" below stand for parts and percents by mass, and "degree of polymerization" stands for "average degree of polymerization", unless stated otherwise.

Example 1

<Fabrication of Inkjet Recording Medium>

(Preparation of Coating Liquid for Forming First Layer)

A total of 100 parts of kaolin (trade name: Kaobright 90, Shiroishi Calcium KK), 3.8 parts of 0.1 N sodium hydroxide (manufactured by Wako Pure Chemical Industries, Ltd.), 1.2 part of 40% sodium polyacrylate (trade name: Aron T-50, Toagosei Chemical Co.), and 48.8 parts of water were mixed, dispersing was performed using a non-bubbling kneader (trade name: NBK-2, Nippon Seiki Co., Ltd.), and a 65% kaolin dispersion was obtained. Then, 6.9 parts of the obtained 65% kaolin dispersion, 0.8 part of 10% Emulgen 109P (trade name, Kao Corp.), and 5.4 parts of an aqueous solution of 10% anionic polymer (sodium polystyrene sulfonate) VERSA TL YE180 (trade name, Nippon NSC Co., Ltd.) as an aqueous solution of an antistatic agent were added to 100 parts of 22.5% polyester-type urethane latex aqueous dispersion (glass transition temperature 49° C., lowest film forming temperature 29° C., trade name: Hydran AP-40F, Dainippon Ink And Chemicals, Inc.), and the components were thoroughly kneaded and mixed. The liquid temperature of the obtained liquid mixture was maintained at 15-25° C. to obtain a coating liquid for forming a first layer with a concentration of 24.0% (coating liquid for a lower coating layer).

The amount of sodium polyacrylate serving as a pigment dispersant in the coating liquid for forming a first layer was 0.08% by mass based on the total amount of solids in the first layer.

(Preparation of Coating Liquid for Forming Second Layer)

A total of 100 parts of kaolin (trade name: Kaobright 90, Shiroishi Calcium KK) and 1.2 part of 40% sodium polyacrylate (trade name Aron T-50, Toagosei Chemical Co.) were mixed and dispersed in water using NBK-2 (trade name; Nippon Seiki Co., Ltd.). A total of 100 parts of 7% PVA 245 (trade name; Kuraray Co.) and 3.7 parts of a 10% aqueous solution of Emulgen 109P (trade name; Kao Corp.) were then added to the dispersion to prepare a coating liquid for forming a second layer (coating liquid for top coating layer) with a final concentration of solids of 27%.

(Formation of First Layer)

The obtained coating liquid for forming a first layer was coated using an extrusion die coater on one and then the other side of a high-grade paper (trade name: Shiraoi, Nippon Paper Industries Co., Ltd.) having a basis weight of 81.4 g/m$^2$, while adjusting the amount coated on one side to 8.0 g/m$^2$. A first layer (lower coating layer) was then formed by drying for 1 min at a blowing rate of 15 m/sec at a temperature of 85° C. The below-described soft calender processing was performed with respect to the formed first layer. The thickness of the formed first layer was 8.4 μm.

—Soft Calender Processing—

The high-grade paper having the first layer formed on the paper surface was subjected to a soft calender processing by using a roll pair composed of a metal roll and a resin roll under the following conditions: surface temperature of the metal roll 50° C., nip pressure 50 kg/cm.

(Formation of Second Layer)

After the soft calender processing, the coating liquid for forming a second layer that was prepared in the above-described manner was coated on one and then the other side of the high-grade paper having the first layer formed thereon. The coating was performed using an extrusion die coater so as to obtain a dry weight on one side of 20 g/m$^2$, and the coating was dried for 1 min at a blowing rate of 10 m/sec and a temperature of 70° C. to form the second layer. The second layer was then soft calender processed in the same manner as the first layer. The thickness of the formed second layer was 20.6 μm The recording medium (inkjet recording medium) in accordance with the invention was thus produced.

(Measurement and Evaluation)

The following measurements and evaluations were performed with respect to the obtained inkjet recording medium. The results of measurements and evaluation are shown in Table 1.

—1. Cobb Water Absorption Degree—

A Cobb water absorption degree (amount, g/m$^2$, of penetrated water within a contact time of 120 sec at a water temperature of 20° C.) was measured at a surface of the first layer of the high-grade paper having the first layer formed thereon, by a water absorption test conforming to JIS P8140.

—2. Water Absorption Test After Coating the Second Layer—

The following measurements were performed by a Bristow method.

Figure 4:
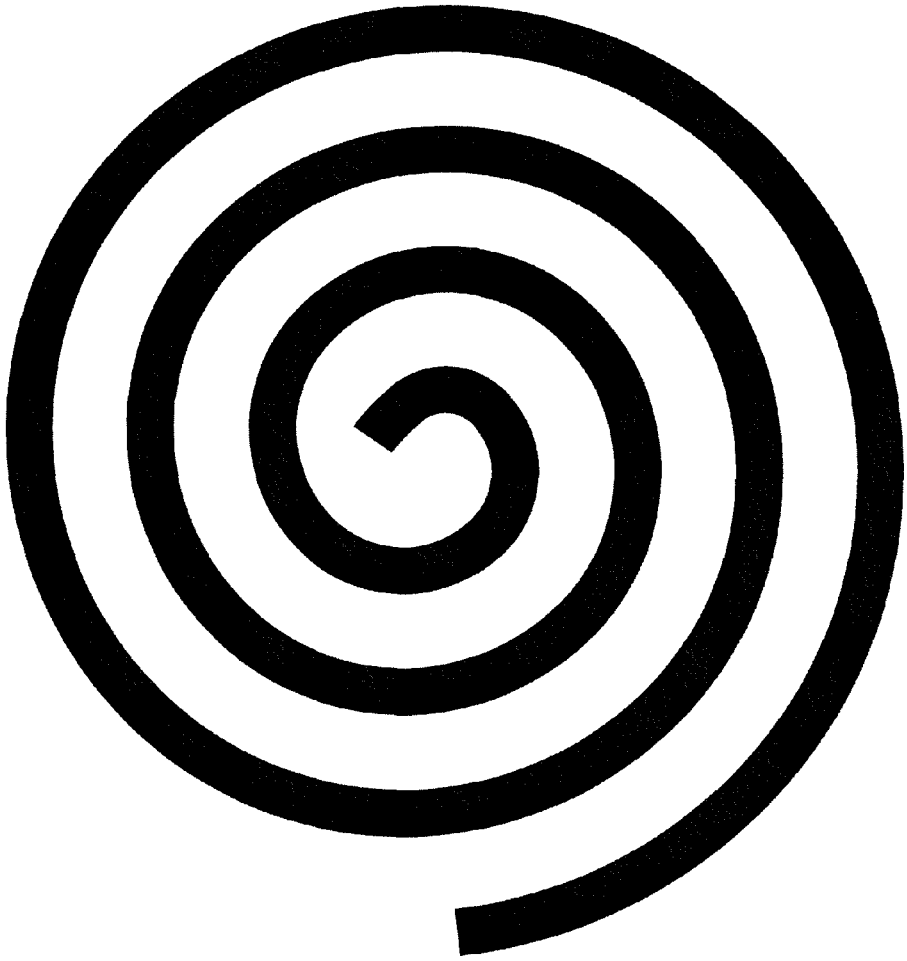
FIG. 4 serves to explain a scanning line of a head filled with a test liquid in a Bristow method.
Figure 5:
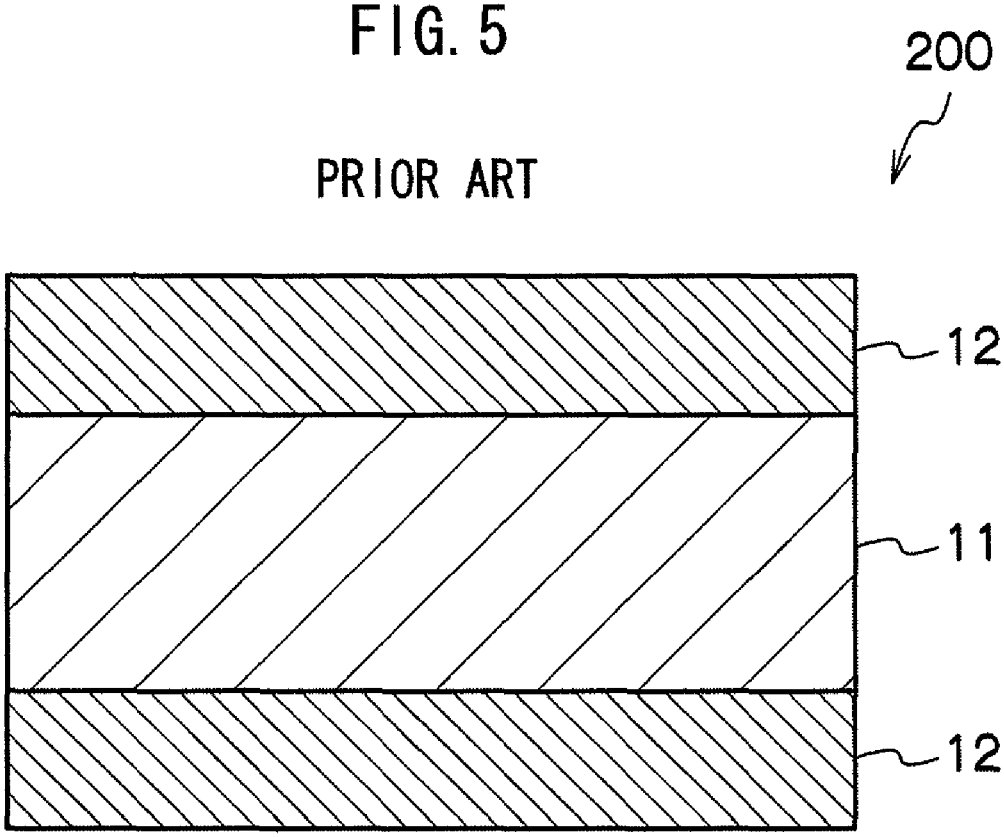
FIG. 5 PRIOR ART
FIG. 5 is a schematic structural diagram illustrating a configuration of the conventional recording medium.

The obtained inkjet recording medium was cut to an A6 size to obtain a sample piece of the second layer, and the sample piece was placed at a measurement platform. A head filled with a test liquid was brought into contact with the sample piece, and liquid absorption characteristics were measured by automatic scanning along a scanning line as shown in FIG. 4 (from inside to outside). The rotation speed (contact time of the paper and ink) of the measurement platform was changed in a stepwise manner, and the relationship between the contact time and the liquid absorption amount (water absorption amount) was obtained by such rotation. The water absorption amount at a contact time of 0.5 sec is shown in Table 1 below.

—3. Measurement of Surface Resistivity—

The high-grade paper having the first layer formed thereon (after coating the coating liquid for forming the first layer and drying, but before the soft calender processing) was humidified for 24 hours under 23° C. and 50% RH environment, and then Highrester UP (trade name, Dia Instrument Inc.) was used to measure the surface resistivity of the first layer surface. The measurement result is shown in Table 1.

—4. Evaluation of Electrostatic Contamination—

A dust produced from fibrous chips containing Nylon fibers as the main component was brought close to the surface of the first layer on the high-grade paper after the first layer has been formed thereon (after the coating liquid for forming the first layer was coated and then the soft calender processing was performed).

Adhesion of dust to the first layer surface was visually observed and the electrostatic contamination was evaluated according to the following criteria.

<Evaluation Criteria>

A: dust adhesion is not observed.

B: dust adhesion is observed, but at a level causing no problems in practical use.

C: dust adhesion is at a large level that can cause problems in practical use.

D: dust adhesion is at a very large level that causes problems in practical use.

<Preparation of Inks>

(1) Preparation of Cyan Pigment Ink C

—Preparation of Pigment Dispersion—

A total of 10 g of cyanine blue A-22 (trade name; PB 15:3, Dainippon Seika Co., Ltd.), 10.0 g of the below-described low-molecular dispersant, 4.0 g of glycerin, and 26 g of ion-exchange water were kneaded and mixed to prepare a dispersion. Then, the dispersion was intermittently irradiated (irradiation 0.5 sec, stop 1.0 sec) with ultrasonic waves by using an ultrasound irradiation device, manufactured by SONICS Co., Vibra-cell VC-750, taper microchip: diameter 5 mm, Amplitude: 30%) within 2 hrs and the pigment was further dispersed to obtain a 20% by mass pigment dispersion.

Low-Molecular Dispersant

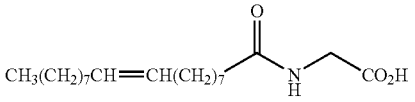

The following compounds were weighed, kneaded and mixed separately from the above-described pigment dispersion to prepare a liquid mixture I.

Glycerin . . . 5.0 g.

Diethylene glycol . . . 10.0 g.

Orfin E1010 (trade name, Nissin Chemical Industry Co., Ltd.) . . . 1.0 g.

Ion-exchange water . . . 11.0 g.

The liquid mixture I was gradually dropwise added to 23.0 g of a stirred 44% SBR dispersion (polymer fine particles: acrylic acid 3%, Tg (glass transition temperature) 30° C.), and a liquid mixture II was prepared by stirring and mixing.

The liquid mixture II was gradually dropwise added to the above-described 20% by mass pigment dispersion under stirring and mixing, and 100 g of pigment ink C (cyan ink) of cyan color was prepared. The pH value of the pigment ink C prepared in the above-described manner was measured using a pH meter WM-50EG (trade name, Toa DKK Co.). The pH value was 8.5.

(2) Preparation of Magenta Pigment Ink M

A pigment ink M (magenta ink) of magenta color was prepared by the method identical to that used in the preparation of the pigment ink C, except that Cromophtal Jet Magenta DMQ (PR-122) (trade name, Chiba Specialty Chemicals Co.) was used instead of the pigment used in the preparation of the pigment in C in the process for preparing the pigment ink C. The pH value of the pigment ink M prepared in the above-described manner was measured using a pH meter WM-50EG (trade name, Toa DKK Co.). The pH value was 8.5.

(3) Preparation of Yellow Pigment Ink Y

A pigment ink Y (yellow ink) of yellow color was prepared by the method identical to that used in the preparation of the pigment ink C, except that Irgalite Jet Yellow GS (PY74) (trade name, Chiba Specialty Chemicals Co.) was used instead of the pigment used in the preparation of the pigment in C in the process for preparing the pigment ink C. The pH value of the pigment ink Y prepared in the above-described manner was measured using a pH meter WM-50EG (trade name, Toa, DKK Co.). The pH value was 8.5.

(4) Preparation of Black Pigment Ink K

A pigment ink K (black ink) of black color was prepared by the method identical to that used in the preparation of the pigment ink C, except that a dispersion CAB-O-JETTM _200 (carbon black) (trade name, CABOT Corp.) was used instead of the pigment dispersion used in the preparation of the pigment in C in the process for preparing the pigment ink C. The pH value of the pigment ink K prepared in the above-described manner was measured using a pH meter WM-50EG (trade name, Toa DKK Co.). The pH value was 8.5.

<Preparation of Treatment Liquid>

The treatment liquid was prepared by mixing the below-described components.

Phosphoric acid . . . 10 g.

Glycerin . . . 20 g.

Diethylene glycol . . . 10 g.

Orfin E1010 (trade name, Nissin Chemical Industry Co., Ltd.) . . . 1 g.

Ion-exchange water . . . 59 g.

The pH value of the treatment liquid prepared in the above-described manner was measured using a pH meter WM-50EG (trade name, Toa DKK Co.). The pH value was 1.0.

<Image Formation, Deposition System, and Conditions>

Four-color single-pass image formation was performed under the below described conditions by using the above-described cyan pigment ink C, magenta pigment ink M, yellow pigment ink Y, black pigment ink K, and treatment liquid and employing the apparatus shown in FIG. 3.

—Head for Treatment Liquid for Precoat Module—

Head: piezo full-line head with a width of 600 dpi/20 inch.

Volume of ejected liquid droplet: two-value recording at 0 and 4.0 pL.

Drive frequency: 15 kHz (conveying speed of recording medium 635 mm/sec).

Image formation pattern: a pattern is employed such that a treatment liquid is applied in advance to a position where an image will be formed with a colored ink of at least one color in the ink formation process.

—Water Drying for Precoat Module (Blowing Drying)—

Blower speed: 15 m/sec.

Temperature: heating is performed with a contact-type flat heater from the rear surface of the recording medium so that the front surface temperature of the recording medium becomes 60° C.

Blowing zone: 450 mm (drying time 0.7 sec).

—Ink Image Formation—

Head: piezo full-line heads with a width of 1,200 dpi/20 inch were arranged for four colors.

Volume of ejected liquid droplet: four-value recording at 0, 2.0, 3.5, and 4.0 pL.

Drive frequency: 30 kHz (conveying speed of recording medium 635 mm/sec).

—Drying (Water Drying, Blow Drying)—

Blower speed: 15 m/sec.

Temperature: 60° C.

Blowing range: 640 mm (drying time 1 sec).

—Heating and Fixing—

Silicone rubber roll (hardness 50°, nip width 5 mm).

Roller temperature: 90° C.

Pressure: 0.8 MPa.

The following evaluation was performed.

—5. Evaluation of Image Bleeding and Color Mixing—

The gray scale and symbol image formed as described hereinabove were visually observed and evaluated according to the following evaluation criteria. The evaluation results are shown in Table 1.

<Evaluation Criteria>

A: no image bleeding or color mixing was observed; the character "Hawk" could be obtained at a resolution equal to or less than 4 pt.

B: no image bleeding or color mixing was observed; the character "Hawk" could be obtained at a resolution equal to 5 pt.

C: large image bleeding and color mixing were observed; utility was low.

D: very large image bleeding and color mixing were observed; utility was very low.

The character "Hawk" is a complicated Japanese character meaning "Hawk".

Example 2 to Example 6

Inkjet recording media were produced in the same manner as in Example 1, except that the type of the antistatic agent in the preparation of the coating liquid for forming the first layer in Example 1 was changed as shown in Table 1 below, and the measurements and evaluations were performed in the same manner as in Example 1. The antistatic agent was prepared and added in the form of a 10% aqueous solution in the same manner as in Example 1. The measurement and evaluation results are shown in Table 1 below.

Example 7

An inkjet recording medium was produced in the same manner as in Example 1, except that the amount of the aqueous solution of the antistatic agent in the preparation of the coating liquid for forming the first layer in Example 1 was changed from 5.4 parts to 2.7 parts, and the measurements and evaluations were performed in the same manner as in Example 1. The measurement and evaluation results are shown in Table 1 below.

Example 8

An inkjet recording medium was produced in the same manner as in Example 1, except that the amount of the aqueous solution of the antistatic agent in the preparation of the coating liquid for forming the first layer in Example 1 was changed from 5.4 parts to 10.8 parts, and the measurements and evaluations were performed in the same manner as in Example 1. The measurement and evaluation results are shown in Table 1 below.

Example 9

An inkjet recording medium was produced in the same manner as in Example 1, except that the amount of the aqueous solution of the antistatic agent in the preparation of the coating liquid for forming the first layer in Example 1 was changed from 5.4 parts to 21.6 parts, and the measurements and evaluations were performed in the same manner as in Example 1. The measurement and evaluation results are shown in Table 1 below.

Example 10

An inkjet recording medium was produced in the same manner as in Example 1, except that the type of the antistatic agent in the preparation of the coating liquid for forming the first layer in Example 1 was changed as shown in Table 1 below, and the measurements and evaluations were performed in the same manner as in Example 1. The antistatic agent was prepared and added in the form of a 10% aqueous solution in the same manner as in Example 1. The measurement and evaluation results are shown in Table 1 below.

Comparative Example 1

An inkjet recording medium was produced in the same manner as in Example 1, except that the amount of the aqueous solution of the antistatic agent in the preparation of the coating liquid for forming the first layer in Example 1 was changed from 5.4 parts to 0 parts (that is, the aqueous solution of the antistatic agent was not added) and water was added in an amount of 5.4 parts. The measurements and evaluations were performed in the same manner as in Example 1. The measurement and evaluation results are shown in Table 1 below.

Comparative Example 2

An inkjet recording medium was produced in the same manner as in Example 1, except that the type of the antistatic agent in the preparation of the coating liquid for forming the first layer in Example 1 was changed as shown in Table 1. The measurements and evaluations were performed in the same manner as in Example 1. The measurement and evaluation results are shown in Table 1 below.

Comparative Example 3

An inkjet recording medium was produced in the same manner as in Example 1, except that the dry weight per one side during the formation of the second layer in Example 1 was changed to 6 g/m$^2$. The measurements and evaluations were performed in the same manner as in Example 1. The measurement and evaluation results are shown in Table 1 below.

Comparative Example 4

An inkjet recording medium was produced in the same manner as in Example 1, except that the amount of 7% PVA 245 aqueous solution added during the formation of the second layer in Example 1 was changed to 50 parts. The measurements and evaluations were performed in the same manner as in Example 1. The measurement and evaluation results are shown in Table 1 below.

Comparative Example 5

An inkjet recording medium was produced in the same manner as in Example 1, except that the dry weight per one side during the formation of the first layer in Example 1 was changed to 4 g/m$^2$. The measurements and evaluations were performed in the same manner as in Example 1. The measurement and evaluation results are shown in Table 1 below.

TABLE 1

| | First layer | | | | Second layer | Evaluation results | |
|---|---|---|---|---|---|---|---|
| | Cobb water absorption degree (g/m$^2$) | Surface resistivity (Ω) | Antistatic agent Type | Antistatic agent Content | Water absorption amount (mL/m$^2$) | Electrostatic contamination | Bleeding, color mixing |
| Example 1 | 1.2 | $5 \times 10^{10}$ | Aqueous solution of anionic polymer (polystyrenesulfonic acid Na) "VERSA TL YE180" (trade name, Nippon NSC Co.) | 2% | 4.1 | A | A |
| Example 2 | 1.4 | $9 \times 10^{10}$ | Aqueous solution of cationic polymer (acrylic cationic polymer) "ASA-197" (trade name, Takamatsu Yushi KK) | 2% | 4.4 | B | A |
| Example 3 | 1.6 | $8 \times 10^{9}$ | Aqueous solution of anionic surfactant (alkylphosphoric acid ester Na) "Prysurf M200B" (trade name, Daichi Kogyo Seiyaku Co., Ltd.) | 2% | 4.2 | A | B |
| Example 4 | 1.5 | $1 \times 10^{10}$ | Aqueous solution of anionic surfactant (alkylphosphoric acid ester Na) "DSK Elenon" (trade name, Daichi Kogyo Seiyaku Co., Ltd.) | 2% | 4.0 | B | B |
| Example 5 | 1.1 | $7 \times 10^{9}$ | Aqueous solution of amphoteric surfactant (imidazoline-type amphoteric surfactant) "Electrostripper AC" (trade name, Kao Corp.) | 2% | 3.8 | A | B |
| Example 6 | 1.5 | $3 \times 10^{10}$ | Aqueous solution of cationic surfactant (imidazoline-type amphoteric surfactant) "Electrostripper QN" (trade name, Kao Corp.) | 2% | 4.3 | B | B |
| Example 7 | 1.0 | $1 \times 10^{11}$ | Aqueous solution of anionic polymer (polystyrenesulfonic acid Na) "VERSA TL YE180" (trade name, Nippon NSC Co.) | 1% | 3.8 | B | B |
| Example 8 | 1.5 | $2 \times 10^{10}$ | Aqueous solution of anionic polymer (polystyrenesulfonic acid Na) "VERSA TL YE180" (trade name, Nippon NSC Co.) | 4% | 4.4 | A | A |
| Example 9 | 1.8 | $5 \times 10^{9}$ | Aqueous solution of anionic polymer (polystyrenesulfonic acid Na) "VERSA TL YE180" (trade name, Nippon NSC Co.) | 8% | 4.6 | A | B |
| Example 10 | 1.3 | $8 \times 10^{9}$ | Aqueous solution of anionic polymer (polyacrylic acid Na) "Aron T-50" (trade name, Toagosei Chemical Co.) | 2% | 4.3 | A | B |
| Comparative Example 1 | 0.8 | $>1 \times 10^{14}$ | None | 0% | 3.7 | C | B |

TABLE 1-continued

| | First layer | | | | Second layer | Evaluation results | |
|---|---|---|---|---|---|---|---|
| | Cobb water absorption degree ($g/m^2$) | Surface resistivity (Ω) | Antistatic agent Type | Content | Water absorption amount ($mL/m^2$) | Electrostatic contamination | Bleeding, color mixing |
| Comparative Example 2 | 3.4 | $5 \times 10^9$ | 10% $Na_2SO_4$ aqueous solution | 2% | 8.3 | B | D |
| Comparative Example 3 | 1.2 | $5 \times 10^{10}$ | Aqueous solution of anionic polymer (polystyrenesulfonic acid Na) "VERSA TL YE180" (trade name, Nippon NSC Co.) | 2% | 1.6 | A | C |
| Comparative Example 4 | 1.2 | $5 \times 10^{10}$ | Aqueous solution of anionic polymer (polystyrenesulfonic acid Na) "VERSA TL YE180" (trade name, Nippon NSC Co.) | 2% | 8.8 | A | C |
| Comparative Example 5 | 8.2 | $5 \times 10^{10}$ | Aqueous solution of anionic polymer (polystyrenesulfonic acid Na) "VERSA TL YE180" (trade name, Nippon NSC Co.) | 2% | 5.8 | B | C |

In Table 1 above, the column "Type" of the antistatic agent indicates the type of the aqueous solution of the antistatic agent.

Further, in Table 1 above, the column "Content" of the antistatic agent indicates the amount (mass. %) of the antistatic agent in the first layer based on the amount obtained by removing the antistatic agent from all solids in the first layer.

As shown in Table 1, in the recording media of Examples 1 to 10 in which the content of the antistatic agent in the first layer is from 0.2% by mass to 10% by mass based on an amount obtained by removing the antistatic agent from all solids in the first layer, a Cobb water absorption degree within a contact time of 120 sec in a water absorption test conforming to JIS P8140 at a surface of the first layer of the base paper provided with the first layer is 2.0 $g/m^2$, or less and a surface resistivity on the surface of the second layer is $1\times10^{12}\Omega$ or less; and a water absorption amount within a contact time of 0.5 sec determined by a Bristow test at a surface of the second layer is from 2 $mL/m^2$ to 8 $mL/m^2$, electrostatic contamination was inhibited and the image bleeding and color mixing were also inhibited.

The invention includes the following embodiments.

<1> A recording medium in which a base paper, a first layer including a binder and at least one antistatic agent, and a second layer including a white pigment are formed in this order;

the content of the antistatic agent includes from 0.2% by mass to 10.0% by mass based on an amount obtained by removing the antistatic agent from all solids in the first layer;

the Cobb water absorption degree within a contact time of 120 sec at a surface of the first layer of the base paper provided with the first layer is 2.0 $g/m^2$ or less, and the surface resistivity at 50% RH and 23° C. on the surface is $1\times10^{12}\Omega$ or less; and a water absorption amount within a contact time of 0.5 sec determined by a Bristow test at a surface of the second layer is from 2 $mL/m^2$ to 8 $mL/m^2$.

<2> The recording medium according to <1>, wherein the at least one antistatic agent includes an anionic polymer.

<3> The recording medium according to <1>, wherein the at least one antistatic agent includes sodium polystyrenesulfonate.

<4> The recording medium according to <1>, wherein the at least one antistatic agent includes a cationic polymer.

<5> The recording medium according to <1>, wherein the at least one antistatic agent includes an anionic surfactant.

<6> The recording medium according to <1>, wherein the at least one antistatic agent includes an amphoteric surfactant.

<7> The recording medium according to <1>, wherein the at least one antistatic agent includes a cationic surfactant.

<8> The recording medium according to <1>, wherein the binder contained in the first layer comprises a thermoplastic resin.

<9> The recording medium according to <8>, wherein the thermoplastic resin is the at least one selected from polyester urethane latexes and/or acryl silicone latexes.

<10> The recording medium according to <1>, wherein the first layer further comprises a white pigment.

<11> The recording medium according to <1>, wherein the white pigment is kaolin.

<12> A method for manufacturing the recording medium of <8>, comprising:

applying a film forming liquid comprising thermoplastic resin particles and an antistatic agent to a base paper and heat treating within a temperature range equal to or higher than the lowest film forming temperature of the thermoplastic resin particles, thereby forming a first layer in which the content of the antistatic agent is from 0.2% by mass to 10.0% by mass based on an amount obtained by removing the antistatic agent from all solids in the first layer; and forming a second layer by applying a film forming liquid including a white pigment to the first layer.

<13> The method for manufacturing a recording medium according to <12>, wherein the thermoplastic resin particles are at least one selected from polyester urethane latexes and/or acryl silicone latexes.

<14> An inkjet recording method comprising:

applying an ink to the recording medium according to <1> and forming an ink image correspondingly to predetermined image data; and drying and removing an ink solvent from the recording medium on which the ink image has been formed.

<15> An inkjet recording method comprising:

supplying a treatment liquid comprising an acidic substance onto the recording medium according to <1>;

applying an ink to the recording medium onto which the treatment liquid has been supplied and forming an ink image correspondingly to predetermined image data; and drying and removing an ink solvent from the recording medium on which the ink image has been formed.

All publications, patent applications, and technical standards mentioned in this specification are herein incorporated by reference to the same extent as if each individual publication, patent application, or technical standard was specifically and individually indicated to be incorporated by reference.

What is claimed is:

1. A recording medium in which a base paper, a first layer including a binder and at least one antistatic agent, and a second layer including a white pigment, are formed in this order;

the content of the antistatic agent is from 0.2% by mass to 10.0% by mass based on an amount obtained by removing the antistatic agent from all solids in the first layer;

the Cobb water absorption degree within a contact time of 120 sec at a surface of the first layer of the base paper provided with the first layer is 2.0 $g/m^2$ or less, and the surface resistivity at 50% RH and 23° C. on the surface is $1\times10^{12}\Omega$ or less; and a water absorption amount within a contact time of 0.5 sec determined by a Bristow test at a surface of the second layer is from 2 $mL/m^2$ to 8 $mL/m^2$.

2. The recording medium according to claim 1, wherein the at least one antistatic agent includes an anionic polymer.

3. The recording medium according to claim 1, wherein the at least one antistatic agent includes sodium polystyrenesulfonate.

4. The recording medium according to claim 1, wherein the at least one antistatic agent includes a cationic polymer.

5. The recording medium according to claim 1, wherein the at least one antistatic agent includes an anionic surfactant.

6. The recording medium according to claim 1, wherein the at least one antistatic agent includes an amphoteric surfactant.

7. The recording medium according to claim 1, wherein the at least one antistatic agent includes a cationic surfactant.

8. The recording medium according to claim 1, wherein the binder contained in the first layer comprises a thermoplastic resin.

9. The recording medium according to claim 8, wherein the thermoplastic resin is at least one selected from polyester urethane latexes and/or acryl silicone latexes.

10. The recording medium according to claim 1, wherein the first layer further comprises a white pigment.

11. The recording medium according to claim 1, wherein the white pigment is kaolin.

12. A method for manufacturing the recording medium of claim 8, comprising:

applying a film forming liquid comprising thermoplastic resin particles and an antistatic agent to a base paper and heat treating within a temperature range equal to or higher than the lowest film forming temperature of the thermoplastic resin particles, thereby forming a first layer in which the content of the antistatic agent is from 0.2% by mass to 10.0% by mass based on an amount obtained by removing the antistatic agent from all solids in the first layer; and forming a second layer by applying a film forming liquid including a white pigment to the first layer.

13. The method for manufacturing a recording medium according to claim 12, wherein the thermoplastic resin particles are at least one selected from polyester urethane latexes and/or acryl silicone latexes.

14. An inkjet recording method comprising:

applying an ink to the recording medium according to claim 1 and forming an ink image correspondingly to predetermined image data; and drying and removing an ink solvent from the recording medium on which the ink image has been formed.

15. An inkjet recording method comprising:

supplying a treatment liquid comprising an acidic substance onto the recording medium according to claim 1;

applying an ink to the recording medium onto which the treatment liquid has been supplied and forming an ink image correspondingly to predetermined image data; and drying and removing an ink solvent from the recording medium on which the ink image has been formed.

* * * * *